US007683838B2

(12) United States Patent
Koyama et al.

(10) Patent No.: US 7,683,838 B2
(45) Date of Patent: Mar. 23, 2010

(54) SEMICONDUCTOR DEVICE

(75) Inventors: Jun Koyama, Sagamihara (JP); Shunpei Yamazaki, Setagaya (JP)

(73) Assignee: Semiconductor Energy Laboratory Co., Ltd, Atsugi-shi, Kanagawa-ken ( * ) Notice: Subject to any disclaimer, the term of this patent is extended or adjusted under 35 U.S.C. 154(b) by 0 days.

(21) Appl. No.: 12/068,400

(22) Filed: Feb. 6, 2008

(65) Prior Publication Data

US 2008/0191959 A1 Aug. 14, 2008

(30) Foreign Application Priority Data

Feb. 9, 2007 (JP) ..... 2007-030858

(51) Int. Cl.
*H01Q 1/38* (2006.01)

(52) U.S. Cl. ..... 343/700 MS; 343/850

(58) Field of Classification Search ..... 343/700 MS, 343/850, 853

See application file for complete search history.

(56) References Cited

U.S. PATENT DOCUMENTS 7,061,083 B1 6/2006 Usami et al.
7,067,845 B2 * 6/2006 Murakami et al. ..... 257/72
7,405,707 B2 * 7/2008 Murofushi et al. ..... 343/725
2007/0176845 A1 * 8/2007 Yamazaki et al. ..... 343/895

FOREIGN PATENT DOCUMENTS

EP 1 148 440 10/2001
JP 2004-078991 3/2004
JP 2005-252853 9/2005

* cited by examiner

*Primary Examiner*—James Cho
(74) *Attorney, Agent, or Firm*—Eric J. Robinson; Robinson Intellectual Property Law Office, P.C.

(57) ABSTRACT

An object is to provide a semiconductor device in which even in the case where a plurality of antennas are provided, there is no limitation on the layout of the antennas so that disconnection between an integrated circuit portion and the antenna and reduction in a communication distance from a communication device can be prevented. An integrated circuit portion which includes a thin film transistor is provided on a first surface of an insulating base. A first antenna is provided over the integrated circuit portion. A second antenna is provided over a second surface of the base. The first antenna is connected to the integrated circuit potion. The second antenna is connected to the integrated circuit portion through a through hole formed in the base. The first antenna and the second antenna overlap with the integrated circuit portion.

15 Claims, 21 Drawing Sheets

SEMICONDUCTOR DEVICE

BACKGROUND OF THE INVENTION

1. Field of the Invention

The present invention relates to a semiconductor device, and particularly relates to a semiconductor device which performs wireless communication by using electromagnetic waves.

2. Description of the Related Art

In recent years, an individual identification technology using electromagnetic waves for wireless communication has attracted attention. In particular, as a semiconductor device which communicates data by wireless communication, an individual identification technology using a semiconductor device (also referred to as an RFID tag, an IC (integrated circuit) tag, an IC chip, an RF tag, a wireless tag, or an electronic tag) utilizing RFID (radio frequency identification) has attracted attention. The individual identification technology using such a semiconductor device utilizing RFID has been useful for production, management, or the like of an individual object, and application to personal authentication has been promoted. Further, recently, a tag which reads and writes data by using a plurality of frequencies has been proposed (for example, Patent Document 1: Japanese Published Patent Application No. 2005-252853).

Such a semiconductor device includes an antenna and an integrated circuit portion which has a signal processing circuit provided with a memory circuit or the like. In general, a plurality of chips each including an integrated circuit portion which is included in a semiconductor device are manufactured from one silicon substrate, and the chips are finely formed so that cost reduction is achieved. For example, Patent Document 2: Japanese Published Patent Application No. 2004-78991 discloses that it is advantageous to manufacture a plurality of chips each under 0.5 mm on a side over a silicon wafer, economically and in terms of the yield.

SUMMARY OF THE INVENTION

However, in a case where a plurality of antennas are provided on one surface in a semiconductor device including the plurality of antennas, there is a possibility that the size or the shape of each antenna are limited because of limitation on the layout of the antennas and thus a communication distance is short. Further, in a case where a plurality of antennas are formed over different substrates and attached to a fine chip provided with an integrated circuit portion, disconnection is a problem.

On the other hand, it is possible that an antenna is formed so as to be incorporated in a chip (on-chip) in order that disconnection between a fine chip and an antenna may be prevented. However, an on-chip antenna which is formed in a fine chip causes problems that the size of the antenna is reduced and a communication distance is shortened. Although it is possible that the size of a chip formed of a silicon substrate is increased in order that disconnection and reduction in a communication distance may be prevented, there are problems such as increase in cost and damage of the silicon chip.

In view of the foregoing problems, an object of the present invention is to provide a semiconductor device in which even in the case where a plurality of antennas are provided, there is no limitation on the layout of the antennas so that disconnection between an integrated circuit portion and the antennas and reduction in a communication distance from a communication device can be prevented.

A semiconductor device of the present invention includes an integrated circuit portion and a plurality of antennas. The size of the integrated circuit portion can be almost the same as a desired antenna size, the integrated circuit portion and the antennas can be easily connected, and signal transmission and reception with a communication device can be reliably performed. A specific structure is described below.

One mode of a semiconductor device of the present invention includes an integrated circuit portion which is provided on a first surface of an insulating base and which includes a thin film transistor, a first antenna which is provided over the integrated circuit portion, and a second antenna which is provided over a second surface of the insulating base. The first antenna is connected to the integrated circuit potion. The second antenna is connected to the integrated circuit portion through a through hole formed in the insulating base. The first antenna and second antenna overlap with the integrated circuit portion.

Another mode of a semiconductor device of the present invention includes an integrated circuit portion which is provided on a first surface of an insulating base and which includes a thin film transistor, a first antenna which is provided over the integrated circuit portion, and a second antenna which is provided over a substrate. The first antenna is connected to and overlaps with the integrated circuit portion. The second antenna is connected to the integrated circuit portion through a through hole formed in the insulating base. The area of the integrated circuit portion is approximately equal to the area of the substrate. For example, the integrated circuit portion can be provided so that the area thereof is 9 to 400 $mm^2$. The substrate may adhere to a second surface of the insulating base.

Another mode of a semiconductor device of the present invention includes a first integrated circuit portion and a second integrated circuit portion which are provided on a first surface of an insulating base and each of which includes a thin film transistor, a first antenna which is provided over the first integrated circuit portion and the second integrated circuit portion, and a second antenna which is provided over a second surface of the insulating base. The first antenna is connected to the first integrated circuit potion. The second antenna is connected to the second integrated circuit portion through a through hole formed in the insulating base. The first antenna and second antenna overlap with the first integrated circuit portion and the second integrated circuit portion.

Another mode of a semiconductor device of the present invention includes an integrated circuit portion which is provided on a first surface of an insulating base and which includes a thin film transistor, a first antenna which is provided over the integrated circuit portion, a second antenna which is provided on a second surface of the insulating base, and a third antenna which is provided over the first antenna. The first antenna is connected to the integrated circuit potion and transmits and receives data through the third antenna. The second antenna is connected to the integrated circuit portion through a through hole formed in the insulating base. The third antenna is a booster antenna which is insulated from the integrated circuit portion. The first antenna, the second antenna, and the third antenna overlap with the integrated circuit portion.

Another mode of a semiconductor device of the present invention includes an integrated circuit portion which is provided on a first surface of an insulating base and which includes a thin film transistor, a first antenna which is provided over the integrated circuit portion, a second antenna which is provided over the first substrate, and a third antenna which is provided over the second substrate. The first substrate adheres to a second surface of the insulating base. The second substrate adheres to an insulating film provided over the first antenna. The first antenna is connected to the integrated circuit potion and transmits and receives data through the third antenna. The second antenna is connected to the integrated circuit portion through a through hole formed in the insulating base. The third antenna is a booster antenna which is insulated from the integrated circuit portion. The integrated circuit portion, the first substrate, and the second substrate have approximately equal areas. For example, the integrated circuit portion can be provided so that the area thereof is 9 to 400 $mm^2$.

In the above structure, any of the followings can be used as a base: a glass substrate, a quartz substrate, a metal substrate, a stainless steel substrate, a plastic substrate, and an insulating film such as a silicon oxide ($SiO_x$) film, a silicon oxynitride ($SiO_xN_y$) (x>y>0) film, a silicon nitride ($SiN_x$) film, or a silicon nitride oxide ($SiN_xO_y$) (x>y>0)film.

In this specification, a "communication device" may be anything as long as it has a means for transmitting and receiving data by wireless communication with a semiconductor device. For example, a reader for reading data, a reader/writer provided with a reading function and a writing function, and the like are given. Further, a mobile phone, a computer, and the like each of which is provided with one or both of a reading function and a writing function are included.

Note that in the present invention, various types of transistors can be applied to a transistor. Therefore, types of transistors which can be applied are not limited to a certain type. For example, a thin film transistor (TFT) including a non-single crystalline semiconductor film typified by amorphous silicon or polycrystalline silicon can be applied. A transistor or the like formed by an ink-jet method or a printing method may also be employed. With use of them, such transistors can be manufactured at a room temperature, can be manufactured at a low vacuum, and can be manufactured using a large substrate. In addition, since such transistors can be manufactured without use of a mask (reticle), the layout of the transistors can be easily changed. A transistor including an organic semiconductor or a carbon nanotube, or other transistors can be applied as well. With use of them, the transistors can be formed over a substrate which can be bent. Note that a non-single crystalline semiconductor film may include hydrogen or halogen. In addition, various types of substrates can be applied to a substrate provided with transistors are formed without limitation to a certain type.

A transistor can have various structures without limitation to a certain structure. For example, a multi-gate structure having two or more gate electrodes may be used. With the multi-gate structure, channel regions are connected in series; therefore, a plurality of transistors are connected in series. With the multi-gate structure, an off current can be reduced, and the withstand voltage of the transistor can be increased, which improves reliability. In addition, even if a drain-source voltage fluctuates when. the transistor operates in a saturation region, drain-source current does not fluctuate very much, and stable characteristics can be provided. In addition, a structure in which gate electrodes are formed above and below a channel may be used. With the use of the structure in which gate electrodes are formed above and below the channel, a channel region is enlarged so that the amount of current flowing therethrough is increased, or a depletion layer can be easily formed, so that the subthreshold swing is decreased. Further, when the gate electrodes are provided above and below the channel, a plurality of transistors are connected in parallel.

Further, a gate electrode may be provided above or below the channel. Either a staggered structure or an inversely staggered structure may be employed. A channel region may be divided into a plurality of regions, or connected in parallel or in series. Further, a source electrode or a drain electrode may overlap with a channel (or a part of it), thereby preventing a charge from being accumulated in a part of the channel and being unstable operation. Further, an LDD region may be provided. By providing an LDD region, an off current can be reduced and reliability can be improved by improving the withstand voltage of a transistor, and further stable characteristics can be obtained since a drain-source current does not change so much even when a drain-source voltage changes in the operation in a saturation region.

It is to be noted in the present invention that a semiconductor device corresponds to a device including a circuit having a semiconductor element (transistor, diode, or the like). Further, a semiconductor device may be a general device which can function by utilizing semiconductor characteristics.

According to the present invention, even in the case where a plurality of antennas are provided, there is no limitation on the layout of the antennas and thus the antennas can have desired shapes. Further, disconnection between the antenna and an integrated circuit portion and reduction in a communication distance from a communication device can be prevented.

DETAILED DESCRIPTION OF THE INVENTION

Figure 1A:
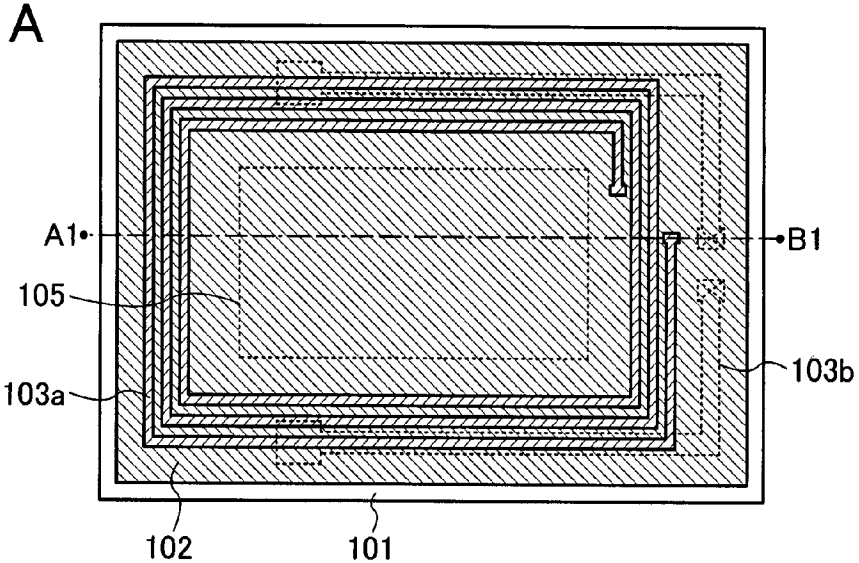
FIGS. 1A and 1B are views showing a structural example of a semiconductor device of the present invention.

Although the present invention will be fully described by way of embodiment modes with reference to the accompanying drawings, it is to be understood by those skilled in the art that various changes and modifications are possible without departing from the spirit and scope of the present invention. Therefore, the present invention should not be construed as being limited to the description in the following embodiment modes. Note that common portions and portions having a similar function are denoted by the same reference numerals in the drawings in this specification, and description thereof may be omitted.

Embodiment Mode 1

A semiconductor device of the present invention includes a plurality of antennas provided on different surfaces, in which antennas provided on at least one surface are on-chip antennas formed over an integrated circuit portion. A structure including a plurality of antennas provided on two different surfaces, in which antennas provided on one surface are on-chip antennas formed in the same step as an integrated circuit, is described below with reference to FIGS. 1A and 1B. Note that FIG. 1A is a schematic top view of a semiconductor device and FIG. 1B is a schematic cross-sectional view along line A1-B1 in FIG. 1A.

The semiconductor device described in this embodiment mode includes an integrated circuit portion 102 which is provided on a first surface (hereinafter also referred to as one surface) of an insulating base (here, a substrate 101), a first antenna 103*a* which is provided over the integrated circuit portion 102, and a second antenna 103*b* which is provided over a second surface (hereinafter also referred to as the other surface) of the insulating base (the substrate 101). The first antenna 103*a* is an on-chip antenna formed over the integrated circuit portion 102 and electrically connected to the integrated circuit potion 102 so as to overlap therewith. The second antenna 103*b* is an antenna provided so as to be electrically connected to the integrated circuit portion 102 through a through hole 104 formed in the insulating base (the substrate 101).

Figure 1B:
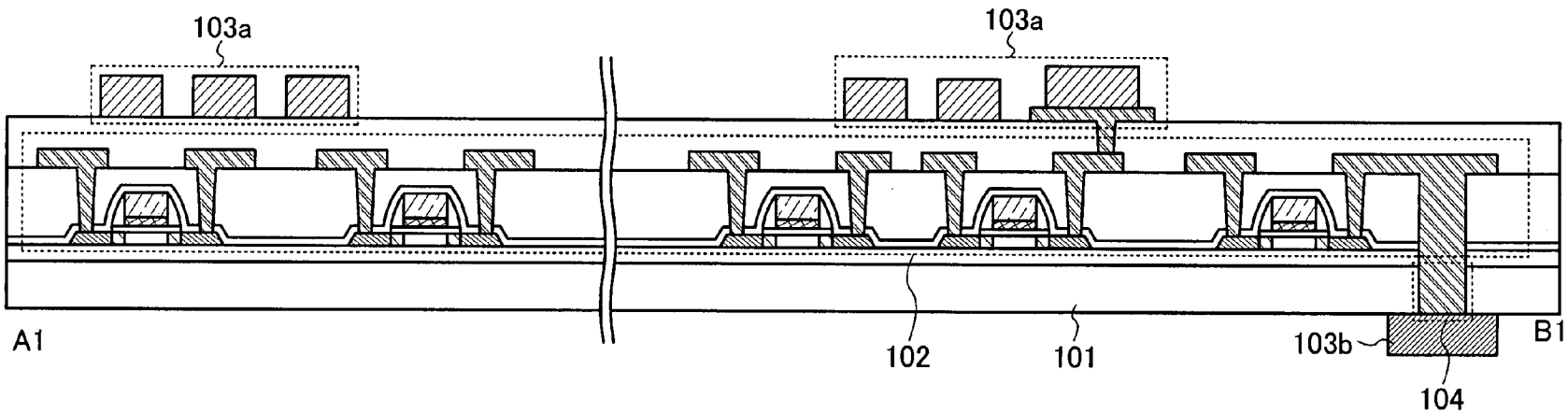

The semiconductor device shown in FIGS. 1A and 1B can have a structure in which the first antenna 103*a* and the second antenna 103*b* receive different frequencies. For example, the first antenna 103*a* is provided in a coil shape and the second antenna 103*b* is provided in a linear shape (L-shape), so that the semiconductor device can receive different frequencies. Note that in a case of providing a coil antenna in the semiconductor device, it is desirable to provide a region 105 provided with no element, such as a transistor in the integrated circuit portion 102 located on an inner side of the coil antenna. By provision of the region 105, an electrical field is allowed to easily pass through when the first antenna 103*a* provided in a coil shape communicates with a communication device by electromagnetic induction.

As the substrate 101, a glass substrate, a quartz substrate, a metal substrate, a stainless steel substrate, a plastic substrate, or the like is used. Such a substrate has no significant limitation on its area or its shape as compared to a silicon (Si) substrate. Thus, in a case of using a substrate which is a rectangular shape having a side length of 1 meter or longer for example, productivity can be significantly increased. Such a merit is greatly advantageous as compared to a case of using a circular silicon substrate. Therefore, even in a case of forming the integrated circuit portion 102 larger (for example, the area thereof is 9 to 400 $mm^2$), the cost can be low as compared to the case of using a silicon substrate and the first and second antennas 103*a* and 103*b* can be formed larger so that a communication distance can be extended. Further, by forming the substrate 101 using a flexible material, the semiconductor device can be provided on a curved surface of a product, or the like.

The integrated circuit portion 102 includes elements such as a transistor, a wiring for connecting these elements, and the like and is provided for a chip obtained by cutting a large substrate over which a plurality of chips are formed. The element included in the integrated circuit portion 102 can be a thin film transistor having a non-single crystal semiconductor film typified by an amorphous silicon film, a polycrystalline silicon film, or the like. Using a thin film transistor has various merits. For example, a semiconductor device using a thin film transistor can be manufactured at lower temperature than a semiconductor device using single crystal silicon obtained by cutting a silicon wafer; therefore, the manufacturing cost can be reduced or the size of a manufacturing apparatus can be increased. Since the manufacturing apparatus can be larger, it can be formed over a large substrate. A number of semiconductor devices can be concurrently manufactured and thus can be formed at low cost. Further, since a manufacturing temperature is low, a substrate with low heat resistance can be used. Therefore, a transistor can be formed over an inexpensive glass substrate. Being transparent, the glass substrate can control transmission of light in the semiconductor device using the transistor over a substrate. Since the film thickness of the transistor is thin, part of a film included in the transistor can transmit light. Therefore, the design of the semiconductor device can be improved.

The first antenna 103*a* may be formed in the following manner: after a conductive film is formed by a sputtering method, a CVD method, a spin coating method, or the like, the conductive film is patterned; the conductive film is formed by a screen printing method, or a droplet discharging method typified by an ink-jet method; or the conductive film is formed by a plating technique such as an additive method or a semi-additive method, or the like. The second antenna 103*b* may be provided on a surface different from the surface on which the first antenna 103*a* is formed with the substrate 101 interposed therebetween so as to be electrically connected to the integrated circuit portion 102.

FIGS. 1A and 1B show an example in which the second antenna 103*b* is formed on the other surface of the substrate 101. In this case, the second antenna 103*b* can be formed on the other surface of the substrate 101 by a droplet discharging method, a screen printing method, or the like. Alternatively, a substrate over which the second antenna 103*b* has been provided and the other surface of an insulating base (here, the substrate 101) may be attached (adhered to) with an adhesive resin. In the case where they are attached, the second antenna 103*b* and the integrated circuit portion 102*b* can be electrically connected using a conductive particle or the like.

The through hole 104 may be formed to have any shape (a rectangular shape, a circular shape, an ellipsoidal shape, or the like).

The region 105 is a region in the integrated circuit portion 102, which is not provided with a wiring, an element such as a transistor, or the like, and is not necessarily provided. The region 105 is preferably provided in order to allow an electrical field to easily pass through in the case where one of the antennas 103*a* and 103*b* has a coil shape, or the like.

As shown in FIGS. 1A and 1B, the plurality of antennas are provided on different surfaces; therefore, the size of each of the antennas can be made larger. As a result, an electromagnetic wave having a long wavelength can be received and a communication distance can be extended. Further, since the layout of each of the antennas can be freely designed, various antenna shapes can be formed in accordance with the wavelength of an electromagnetic wave which is received. When the antennas provided on the one surface are on-chip antennas, it is not necessary to attach the antennas formed over different substrates to the integrated circuit portion; therefore, disconnection between the integrated circuit portion and the antenna can be prevented.

The second antenna 103*b* provided by the attaching or the like may be provided over the first antenna 103*a*. However, by providing the second antenna 103*b* on a surface of the substrate 101, which is the reverse of the surface over which the integrated circuit portion 102 and the first antenna 103*a* are provided, a wiring used for connecting the integrated circuit portion 102 and the second antenna 103*b* does not limit a position where the first antenna 103*a* is provided, which is preferable.

The semiconductor device described in this embodiment mode is provided so that the area S of the integrated circuit portion 102 approximates the area S' of the substrate 101. Preferably, they are approximately equal to each other (S=S'). By provision of the semiconductor device in this manner, the first antenna 103*a* formed in the same step as the integrated circuit portion 102 can be formed larger; therefore, a communication distance can be extended. In this embodiment mode, a plurality of chips each of which is provided with the integrated circuit portion 102 can be formed from one large substrate as described above. Thus, even in the case of forming the integrated circuit portion 102 larger, the cost can be reduced as compared to the case of using a Si substrate.

Most part (preferably, all) of the second antenna 103*b* may overlap with the integrated circuit portion 102. By such provision, when performing cutting into a plurality of the integrated circuit portions 102 formed over the large substrate, the cutting can be performed in accordance with the size of the integrated circuit portions 102. Accordingly, a plurality of semiconductor devices can be obtained from one large substrate. Further, since the second antenna 103*b* can be attached to each of the integrated circuit portions 102 before performing cutting into the plurality of integrated circuit portions 102 which are formed over the large substrate, a process can be simplified. In this case, the integrated circuit portion 102 overlaps with the first and second antennas 103*a* and 103*b*. Note that even in the case of providing the second antenna 103*b* and the integrated circuit portions 102 so as to overlap with each other, the integrated circuit portion 102 is provided to have a larger area, so that reduction in a communication distance can be prevented.

Next, the semiconductor device in this embodiment mode is described with reference to block diagrams.

Figure 2:
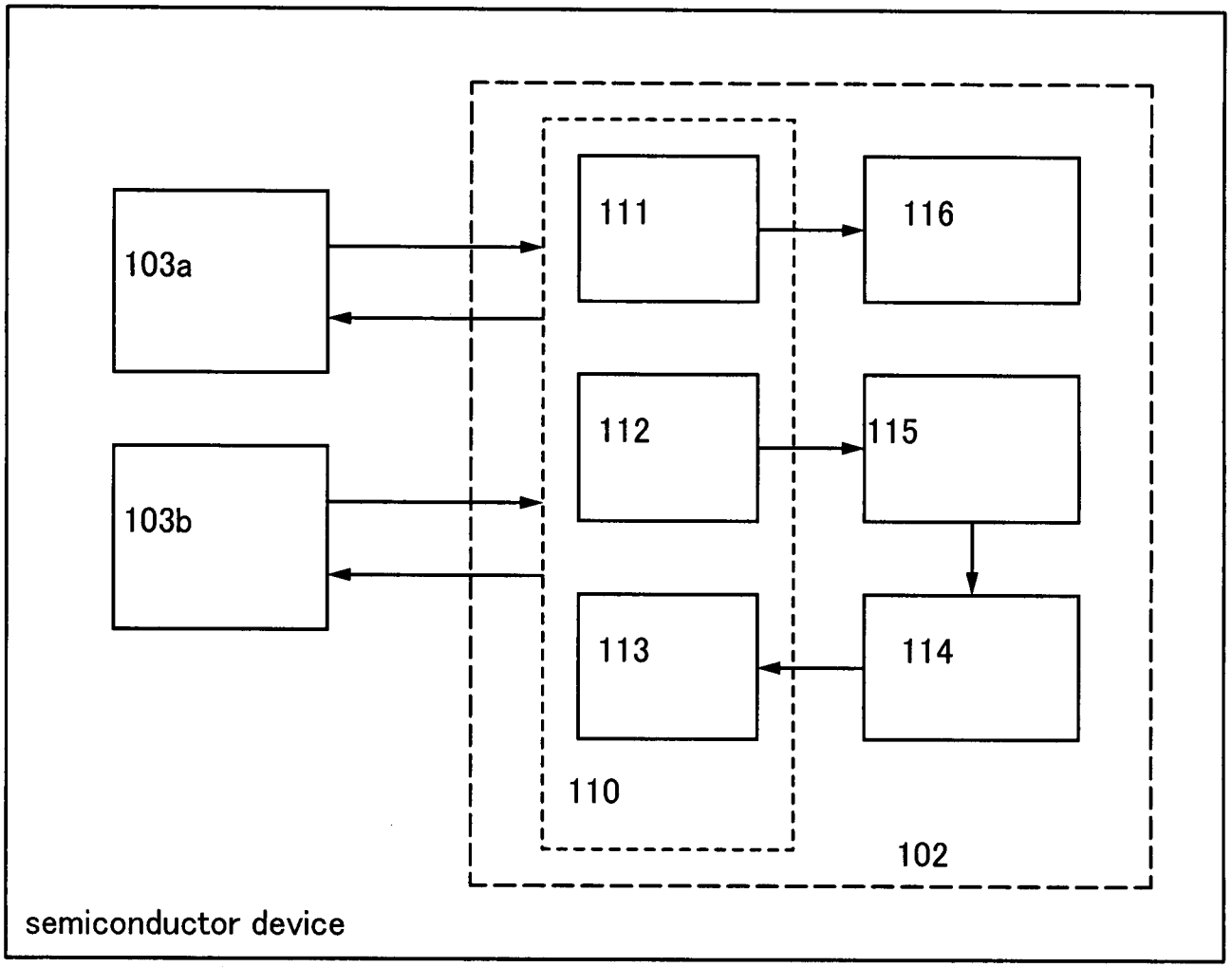
FIG. 2 is a diagram showing an example of a block diagram of a semiconductor device of the present invention.

A semiconductor device shown in FIG. 2 includes a first antenna 103*a*, a second antenna 103*b*, a transmitting and receiving circuit portion 110, a memory circuit 114, a memory control circuit 115, and a power supply circuit 116. The transmitting and receiving circuit portion 110 includes a rectifier circuit 111 for converting power of a wireless signal received by the first antenna 103*a* or the second antenna 103*b* into a power supply potential, a demodulation circuit 112 for extracting data from the wireless signal, and a modulation circuit 113 for transmitting data from the transmitting and receiving circuit portion 110.

The rectifier circuit 111 is, for example, a circuit which rectifies and smoothes an AC signal received by the first antenna 103*a* or the second antenna 103*b* to supply a DC signal to the power supply circuit 116. The demodulation circuit 112 is, for example, a circuit which converts an AC signal received by the first antenna 103*a* or the second antenna 103*b* into a demodulated signal by using a diode or the like and then outputs the demodulated signal to the memory control circuit 115. The modulation circuit 113 can be, for example, a circuit which performs ASK (amplitude shift keying) modulation by changing intensity of a carrier wave outputted from a communication device, which is reflected, in accordance with a change of an input impedance of the semiconductor device, based on data read by the memory control circuit 115, and transmits data to the communication device.

The memory circuit 114 is a circuit which holds data of the integrated circuit portion 102. For the memory circuit 114, any one of a mask ROM, an EPROM, an EEPROM, a flash memory, a ferroelectric memory, and the like which are categorized into nonvolatile memories can be used, for example. Note that a DRAM (dynamic random access memory) and an SRAM (static random access memory) which are categorized into volatile memories may be used as long as a structure is employed in which the semiconductor device is provided with a battery and power is constantly supplied to the memory circuit 114.

The memory control circuit 115 is a circuit which controls reading of data from the memory circuit 114 based on a demodulation signal which is outputted from the transmitting and receiving circuit 110. As an example, a plurality of logic circuits each of which is formed of a thin film transistor are combined so that a circuit which controls reading of data from the memory circuit 114 can be formed.

The power supply circuit 116 can be, for example, a circuit which makes a signal which is inputted be a constant voltage by a regulator formed using a thin film transistor.

Note that as a signal transmission method by wireless communication in the semiconductor device, an electromagnetic coupling method, an electromagnetic induction method (for example, a 13.56 MHz band), or an electric field method (for example, a UHF band (860 to 960 MHz band), a 2.45 GHz band, or the like) can be applied. In the case of employing an electromagnetic coupling method, the first antenna 103*a* and the second antenna 103*b* are provided in coil shapes. In the case of employing an electric field method, the first antenna 103*a* and the second antenna 103*b* may be monopole antennas, dipole antennas, patch antennas, or the like. It is needless to say that the semiconductor device may communicate by one or both of an electromagnetic induction method and an electric field method.

Figure 3:
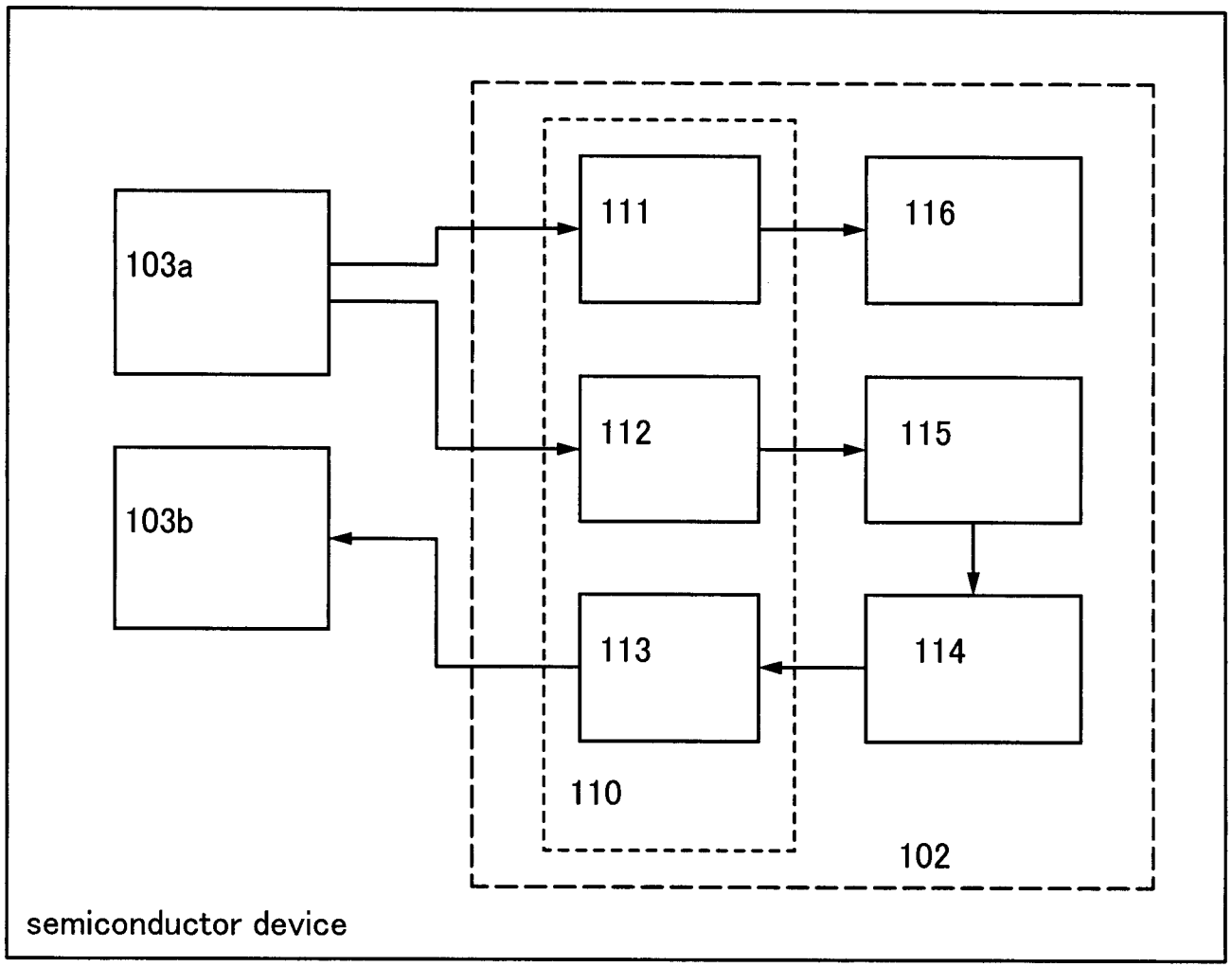
FIG. 3 is a diagram showing an example of a block diagram of a semiconductor device of the present invention.

In the semiconductor device shown in FIG. 2, one of the first antenna 103*a* and the second antenna 103*b* may be an antenna dedicated to reception and the other may be an antenna dedicated to transmission (see FIG. 3). In this case, the semiconductor device can transmit and receive data by utilizing electromagnetic waves having different wavelengths.

Note that while the case is described where the semiconductor device is provided with two antennas in this embodiment mode, the present invention is not limited to this, and three or more antennas may be provided. Even in the case of providing a plurality of antennas, limitation on the layout of the antennas can be reduced by provision of the plurality of antennas on different two surfaces.

This embodiment mode can be combined with the structure of the semiconductor device described in any of the other embodiment modes in this specification.

Embodiment Mode 2

In this embodiment mode, the structure of a semiconductor device different from that of Embodiment Mode 1 is described with reference to the drawings. Note that FIG. 4A is a schematic top view of the semiconductor device and FIG. 4B is a schematic cross-sectional view along line A1-B1 in FIG. 4A.

Figure 4A:
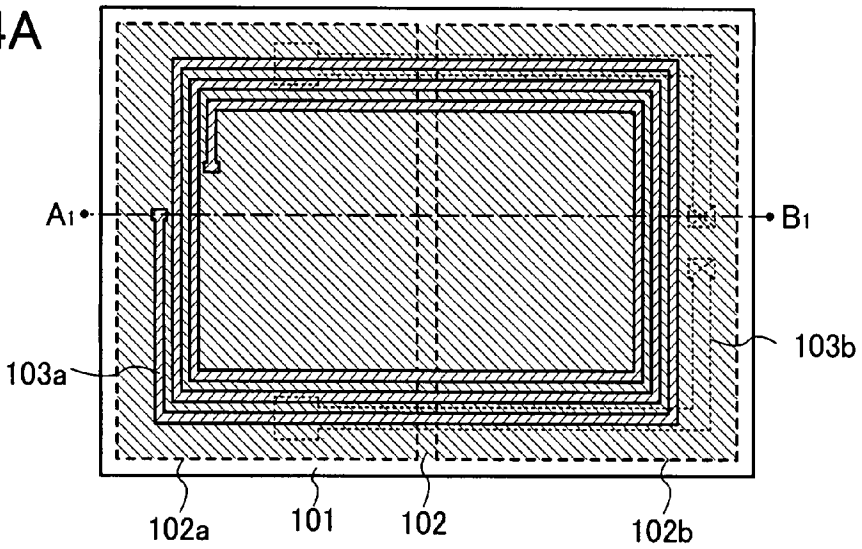
FIGS. 4A and 4B are views showing one structural example of a semiconductor device of the present invention.
Figure 4B:
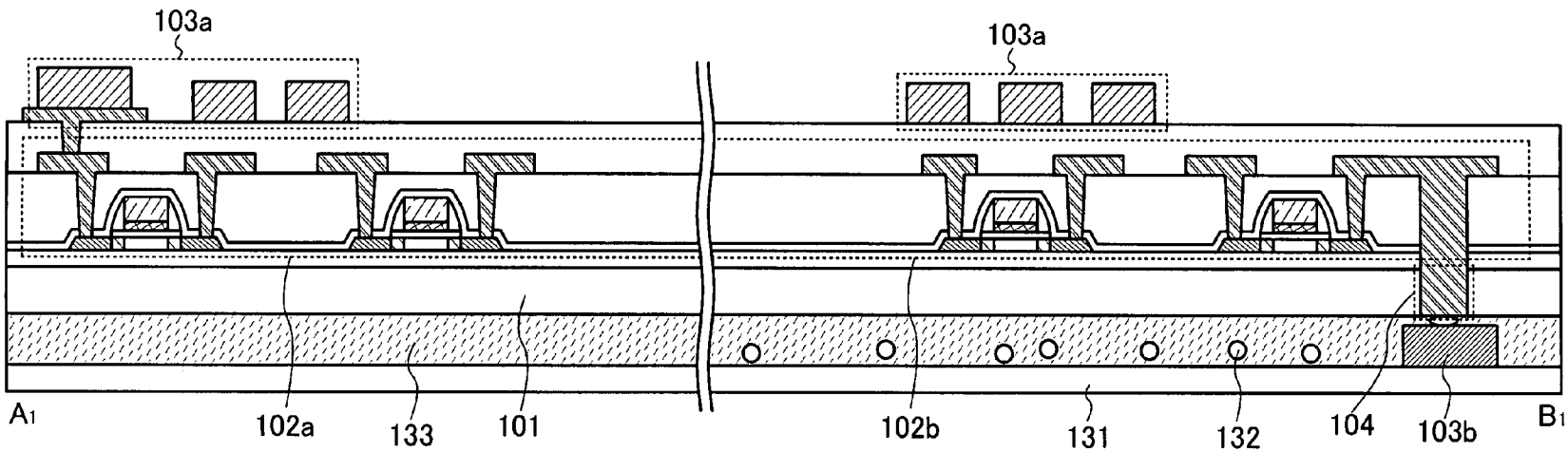

The semiconductor device described in this embodiment mode includes the integrated circuit portion 102 which is provided on a first surface (one surface) of the substrate 101, the first antenna 103*a* which is provided over the integrated circuit portion 102, and the second antenna 103*b* which is provided over a second surface (the other surface) of the substrate 101 (see FIGS. 4A and 4B). The integrated circuit portion 102 includes a first integrated circuit portion 102*a* and a second integrated circuit portion 102*b* which are connected to the first antenna 103*a* and the second antenna 103*b*, respectively.

The first antenna 103*a* is an on-chip antenna which is formed so as to be electrically connected to the first integrated circuit potion 102*a*. The second antenna 103*b* is an antenna provided so as to be electrically connected to the second integrated circuit portion 102*b* through the through hole 104 formed in the substrate 101.

Note that FIGS. 4A and 4B show an example in which a substrate 131 provided with the second antenna 103*b* is attached to the other surface of an insulating base (here, the substrate 101) with an adhesive resin 133. Further, the second antenna 103*b* is electrically connected to the second integrated circuit portion 102*b* with a conductive particle 132. It is needless to say that the second antenna 103*b* may be directly formed on the other surface of the substrate 101, as shown in FIGS. 1A and 1B.

The first integrated circuit portion 102*a* includes a first transmitting and receiving circuit portion 110*a*, a first memory circuit 114*a*, a first memory control circuit 115*a*, and a first power supply circuit 116*a*. The first transmitting and receiving circuit portion 110*a* includes a first rectifier circuit 111*a* for converting power of a wireless signal received by the first antenna 103*a* into a power supply potential, a first demodulation circuit 112*a* for extracting data from the wireless signal, and a first modulation circuit 113*a* for transmitting data from the first transmitting and receiving circuit portion 110*a* (see FIG. 5).

The second integrated circuit portion 102*b* includes a second transmitting and receiving circuit portion 110*b*, a second memory circuit 114*b*, a second memory control circuit 115*b*, and a second power supply circuit 116*b*. The second transmitting and receiving circuit portion 110*b* includes a second rectifier circuit 111*b* for converting power of a wireless signal received by the second antenna 103*b* into a power supply potential, a second demodulation circuit 112*b* for extracting data from the wireless signal, and a second modulation circuit 113*b* for transmitting data from the second transmitting and receiving circuit portion 110*b*.

The semiconductor device described in this embodiment mode differs from the semiconductor device described in Embodiment Mode 1 in that an integrated circuit portion is provided for each of a plurality of antennas, so that transmission and reception of the antennas can be controlled individually. Therefore, wireless signals with different frequencies can be transmitted and received with the antennas at the same time.

In the case of providing a coil antenna in the semiconductor device, it is allowed to provide a region provided with no element such as a transistor in one or both of the first integrated circuit portion 102*a* and the second integrated circuit portion 102*b* which are located on an inner side of the coil antenna. By provision of the region, an electrical field is allowed to easily pass through when the coil antenna communicates with a communication device by electromagnetic induction.

Figure 6A:
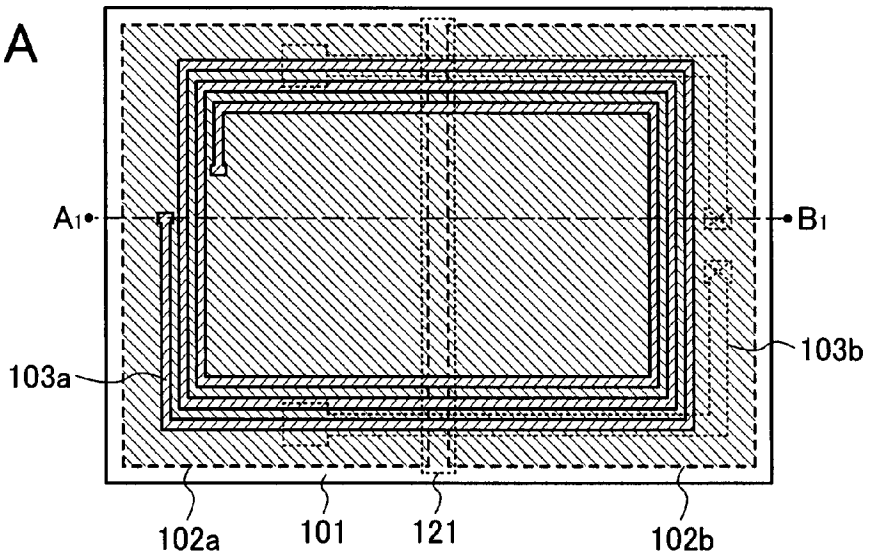
FIGS. 6A and 6B are views showing one structural example of a semiconductor device of the present invention.
Figure 6B:
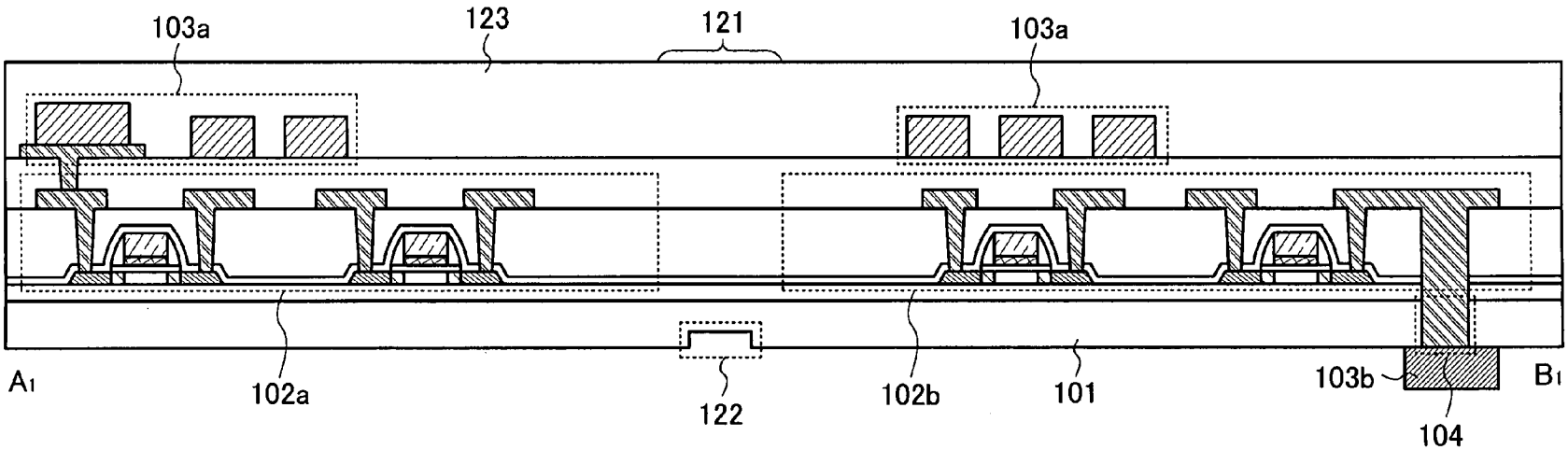

FIG. 6A is a schematic top view of a semiconductor device and FIG. 6B is a schematic cross-sectional view along line A1-B1 in FIG. 6A. In the case of using a flexible material for the substrate 101, the semiconductor device can be provided on a curved surface of a product, or the like. In this case, a region 121 provided with no element such as a transistor is provided between the first integrated circuit portion 102*a* and the second integrated circuit portion 102*b* so that a stress is selectively concentrated in the region, and thus an element can be prevented from being damaged even when the semiconductor device is bent. For example, a depression 122 can be formed in one or both of an insulating film 123, which has a surface of the semiconductor device, in the region 121 and the substrate 101 (the substrate 131 in the case of attaching the second antenna 103*b*) in the region 121 (see FIG. 6B). As a result, if the semiconductor device is bent, a stress can be selectively concentrated in the region 121; therefore, an element such as a thin film transistor can be prevented from being damaged even in the case of providing the semiconductor device along a curved surface.

This embodiment mode can be combined with the structure of the semiconductor device described in any of the other embodiment modes in this specification.

Embodiment Mode 3

In this embodiment mode, the structure of a semiconductor device different from those of Embodiment Modes 1 and 2 is described with reference to the drawings. Note that FIG. 7A is a schematic top view of a semiconductor device and FIG. 7B is a schematic cross-sectional view along line A1-B1 in FIG. 7A.

Figure 7A:
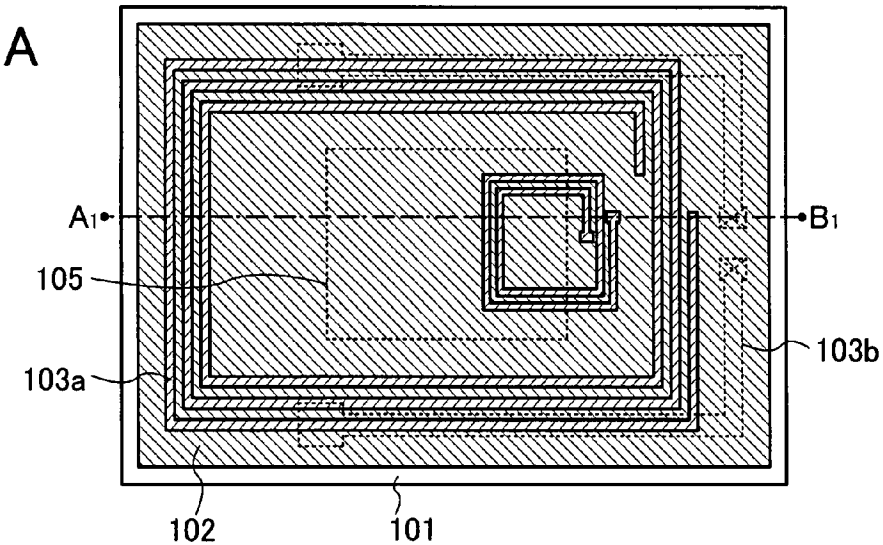
FIGS. 7A and 7B are views showing one structural example of a semiconductor device of the present invention.
Figure 7B:
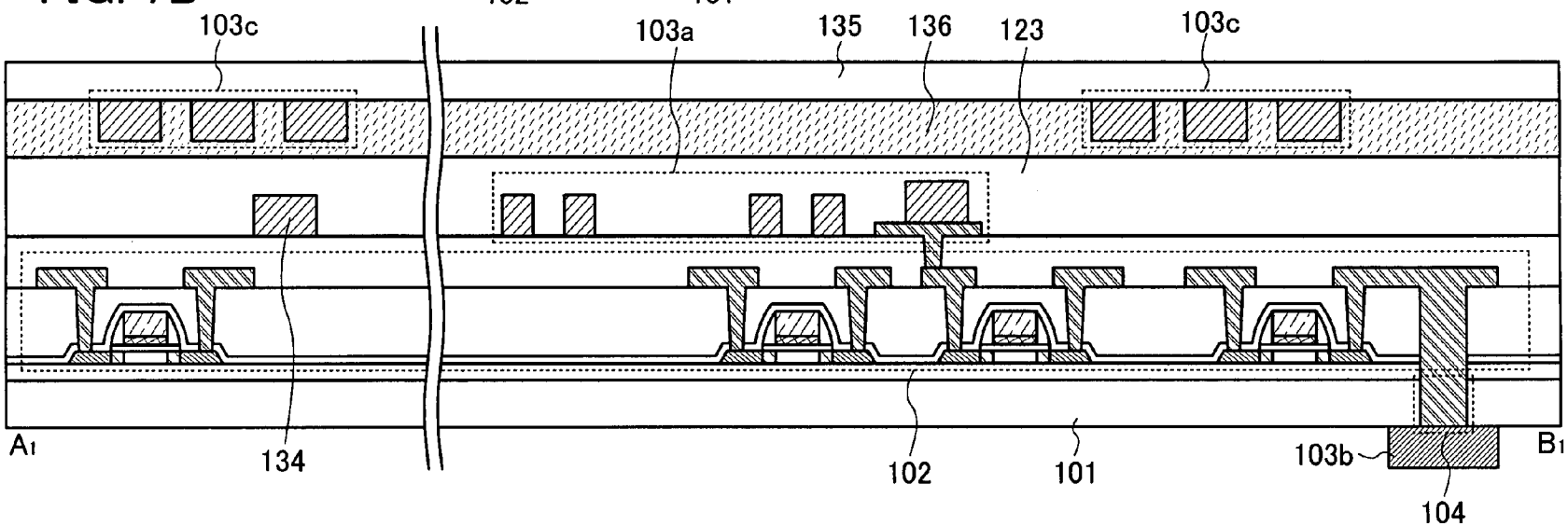

The semiconductor device described in this embodiment mode includes the integrated circuit portion 102 which is provided on a first surface (one surface) of the substrate 101, the first antenna 103*a* which is provided over the integrated circuit portion 102, a third antenna 103*c* which is provided over the first antenna 103*a*, and the second antenna 103*b* which is provided on a second surface (the other surface) of the substrate 101 (see FIGS. 7A and 7B). Here, a case is shown in which the first antenna 103*a* and a wiring 134 which is electrically connected to a thin film transistor included in the integrated circuit portion 102 are provided on one surface.

The first antenna 103*a* is an on-ship antenna which is formed so as to be electrically connected to the integrated circuit potion 102. The second antenna 103*b* is an antenna provided so as to be electrically connected to the integrated circuit portion 102 through the through hole 104 formed in the substrate 101. The third antenna 103*c* is a booster antenna provided so that a communication distance of the first antenna 103*a* is extended.

Note that FIGS. 7A and 7B show an example in which a substrate 135 provided with the third antenna 103*c* is attached to the insulating film 123 with an adhesive resin 136. The third antenna 103*c* which functions as a booster antenna is not needed to be electrically connected to the integrated circuit portion 102 and the first antenna 103*a* and thus is insulated. Therefore, since the third antenna 103*c* is not needed to be electrically connected to the integrated circuit portion 102 or the like even in a case of attaching the third antenna 103*c*, there is no possibility that disconnection is caused.

Note that while FIGS. 7A and 7B show an example in which the second antenna 103*b* is provided on the other surface of the substrate 101, the substrate 131 provided with the second antenna 103*b* may be attached to the other surface of the substrate 101, as shown in FIGS. 4A and 4B.

Figure 5:
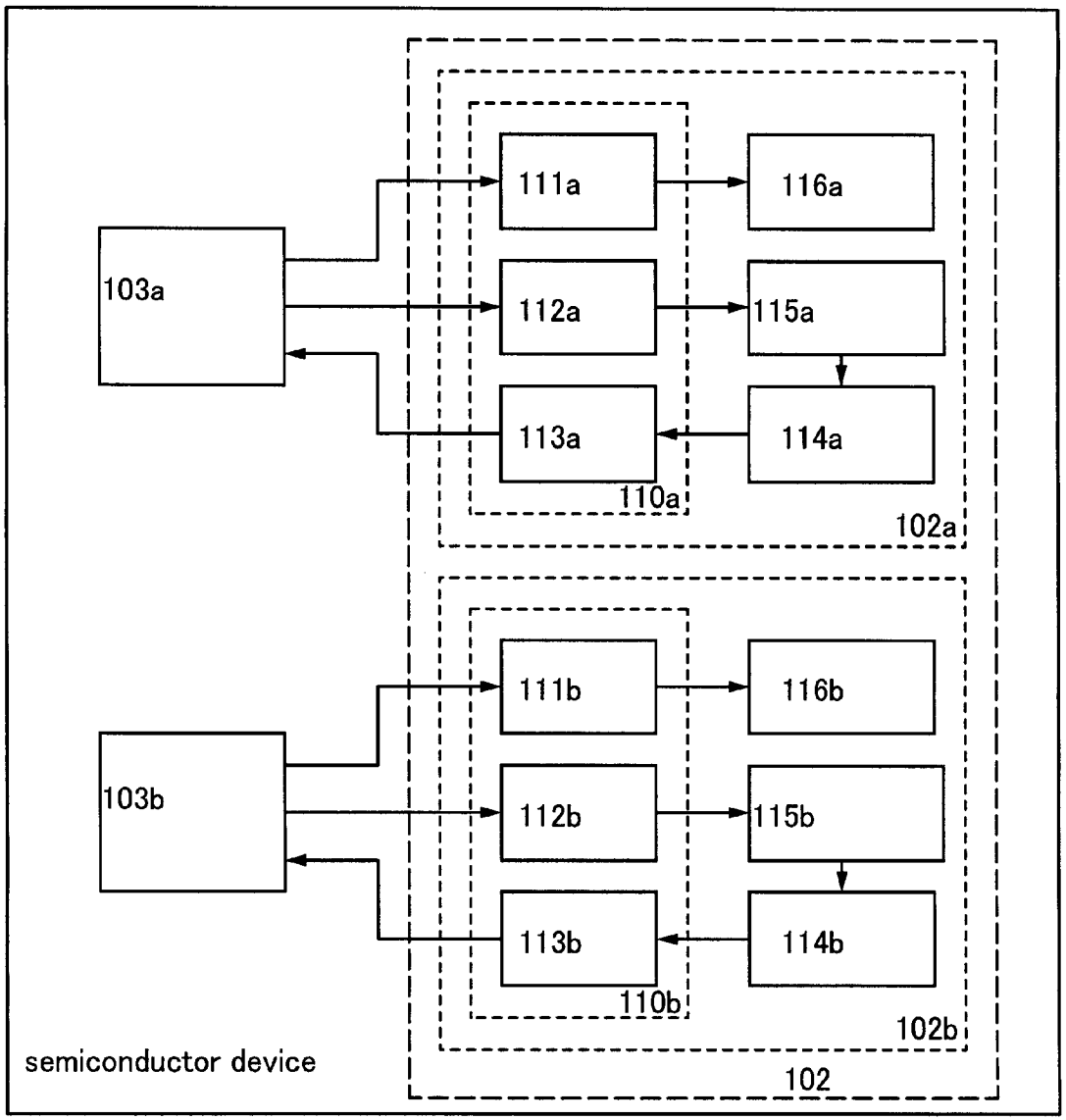
FIG. 5 is a diagram showing an example of a block diagram of a semiconductor device of the present invention.
Figure 8:
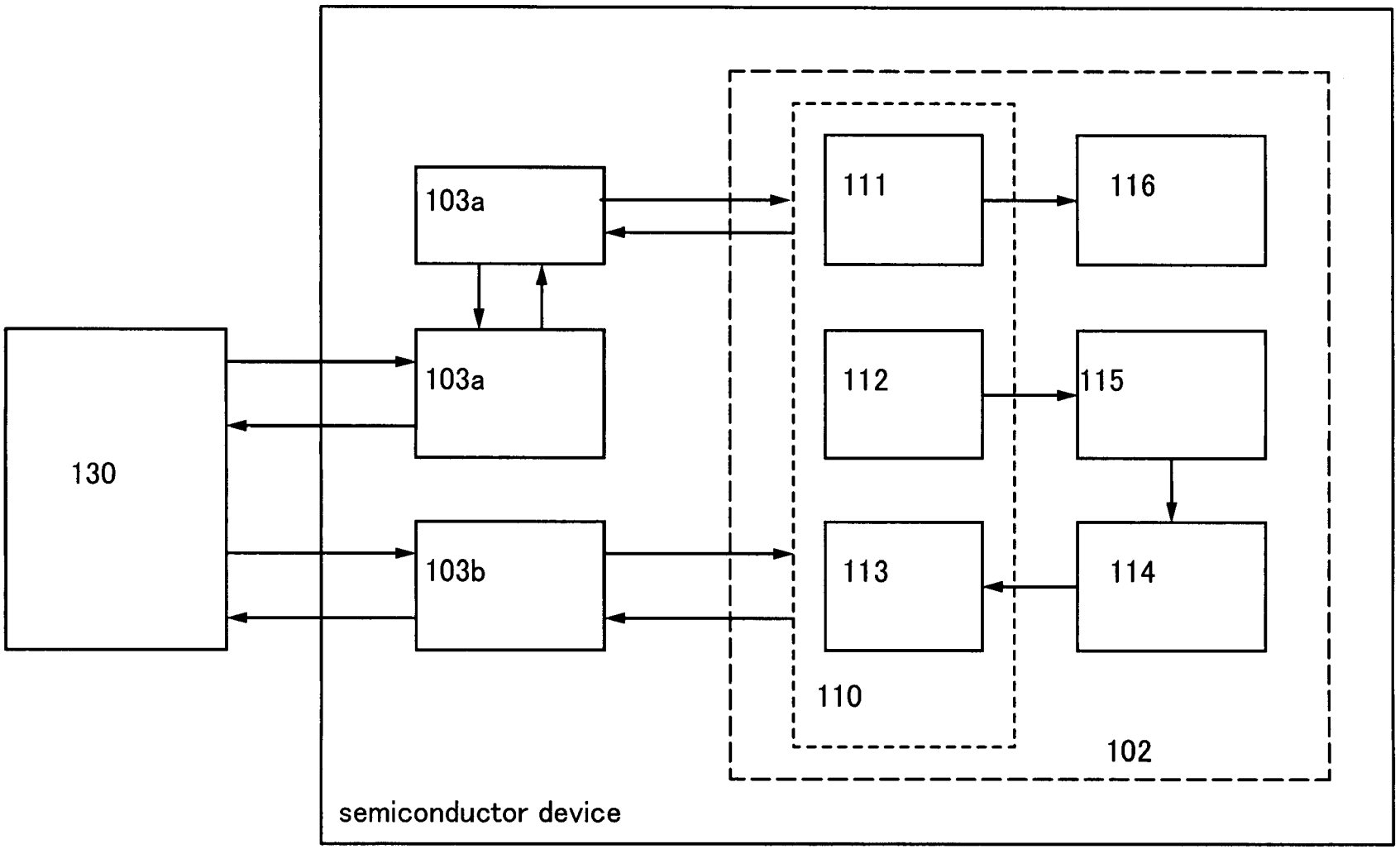
FIG. 8 is a diagram showing an example of a block diagram of a semiconductor device of the present invention.

The semiconductor device described in this embodiment mode performs wireless communication with a communication device 130 by using the second antenna 103*b* and the third antenna 103*c*, and a signal received by the third antenna 103*c* is supplied to the integrated circuit portion 102 by electromagnetic induction with the first antenna 103*a* (see FIG. 8). Note that as shown in FIG. 5, the first integrated circuit portion which is connected to the first antenna 103*a* and the second integrated circuit portion which is connected to the second antenna 103*b* may be provided.

Thus, by provision of the third antenna 103*c*, even in the case where there is a limitation on the layout of the first antenna 103*a*, such as the case where the first antenna 103*a* and the wiring 134 included in the integrated circuit portion 102 are provided on one surface or the case where the plurality of on-chip antennas are provided on one surface, reduction in a communication distance can be prevented.

This embodiment mode can be combined with the structure of the semiconductor device described in any of the other embodiment modes in this specification.

Embodiment Mode 4

In this embodiment mode, an example of a method for manufacturing the semiconductor device described in any of the above embodiment modes is described with reference to the drawings. In this embodiment mode, a case is described in which an integrated circuit portion is formed using an element such as a thin film transistor. In this embodiment mode, a case is described in which an element such as a thin film transistor is once provided over a supporting substrate and then transferred to a flexible substrate, so that a semiconductor device is manufactured. Further, in this embodiment mode, a case is described in which a plurality of antennas and a plurality of chips each of which is provided with an integrated circuit portion are formed over one substrate (here, 4×3 (length by width)), so that a plurality of semiconductor devices are manufactured. In the following description, FIGS. 9A to 10C are schematic top views and FIGS. 11A to 15 are schematic cross-sectional views along line A-B in FIGS. 9A to 10C.

Figure 9A:
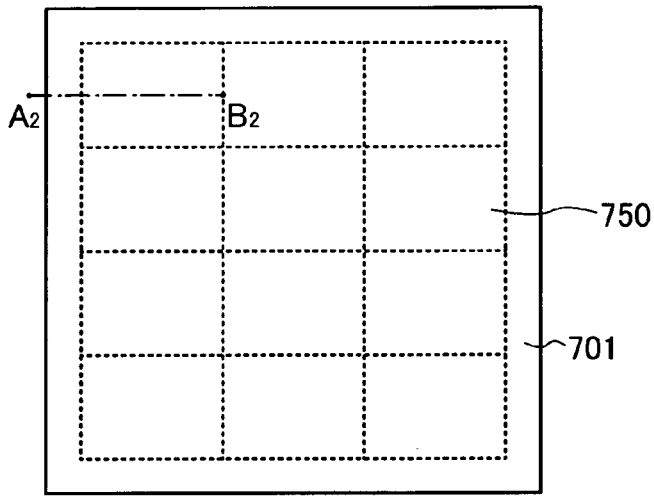
FIGS. 9A to 9C are diagrams showing an example of a method for manufacturing a semiconductor device of the present invention.
Figure 9B:
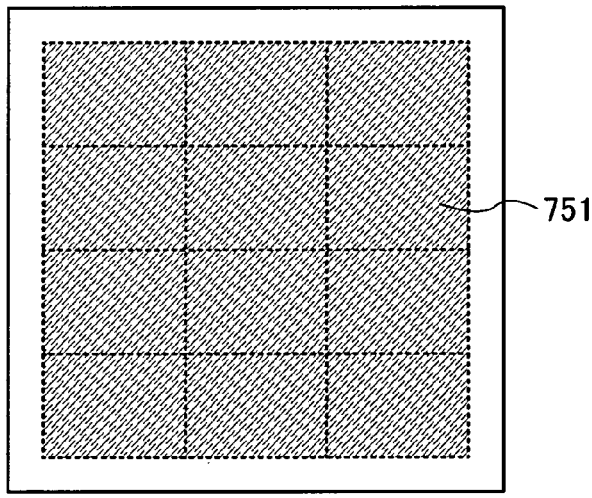
Figures 11A, 11B, 11C, 11D:
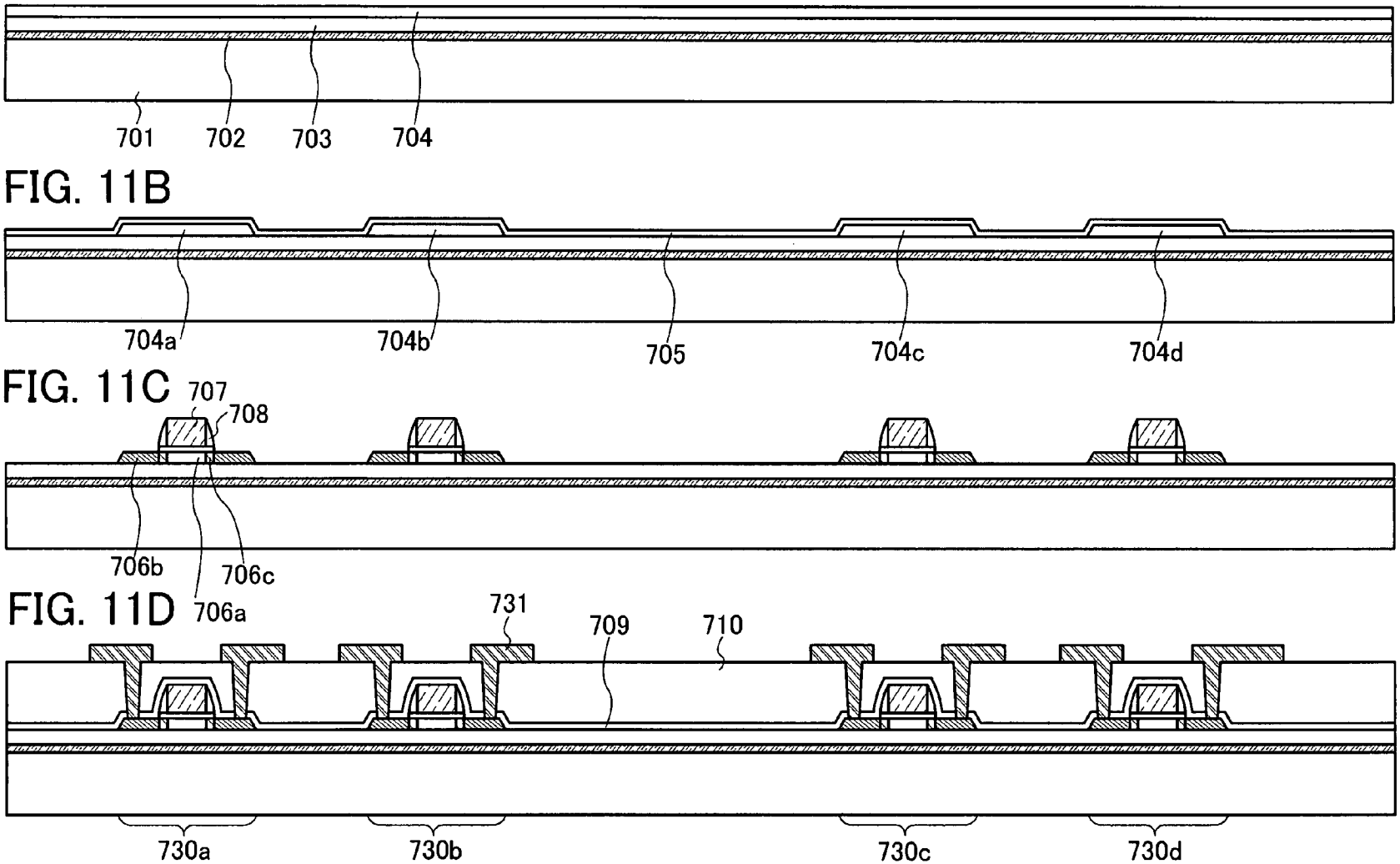
FIGS. 11A to 11D are views showing an example of a method for manufacturing a semiconductor device of the present invention.

First, a release layer 702 is formed on one surface of a substrate 701, and then an insulating film 703 to be a base and an amorphous semiconductor film 704 (for example, a film containing amorphous silicon) are formed (see FIGS. 9A and 11A). The release layer 702, the insulating film 703, and the amorphous semiconductor film 704 can be successively formed. Being formed successively, they are not exposed to the air and thus mixture of an impurity can be prevented. Note that in the following process, an integrated circuit portion and an antenna which are included in the semiconductor device are formed in each of a plurality of regions 750 shown in FIG. 9A.

As the substrate 701, a glass substrate, a quartz substrate, a metal substrate, a stainless steel substrate, a plastic substrate which has heat resistance to a process temperature in the process in this embodiment mode, or the like is preferably used. Such a substrate has no significant limitation on its area or its shape. Thus, for example, in a case of using a substrate which is a rectangular shape having a side length of 1 meter or longer, productivity can be significantly increased. Such a merit is greatly advantageous as compared to a case of using a circular silicon substrate. Therefore, even in a case of forming the integrated circuit portion larger, the cost can be low as compared to the case of using a silicon substrate.

Note that while the release layer 702 is formed over an entire surface of the substrate 701 in this process, the release layer 702 may be selectively formed as necessary by a photolithography method after a release layer is formed over an entire surface of the substrate 701. Further, while the release layer 702 is formed so as to be in contact with the substrate 701, it is also allowed that an insulating film such as a silicon oxide ($SiO_x$) film, a silicon oxynitride ($SiO_xN_y$) (x>y) film, a silicon nitride ($SiN_x$) film, or a silicon nitride oxide ($SiN_xO_y$) (x>y) film is formed and the release layer 702 is formed so as to be in contact with the insulating film, as necessary.

As the release layer 702, a metal film, a stacked layer structure of a metal film and a metal oxide film, or the like can be used. The metal film is formed to have a single-layer structure or a stacked-layer structure of a film formed of an element selected from tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), and iridium (Ir), or an alloy material or a compound material including any of the above elements as its main component. The metal film can be formed by a sputtering method, various CVD methods such as a plasma CVD method, or the like. As the stacked layer structure of a metal film and a metal oxide film, after the above metal film is formed, an oxide or oxynitride of the metal film can be formed on the surface of the metal film by performing plasma treatment in an oxygen atmosphere or an $N_2O$ atmosphere, or heat treatment in an oxygen atmosphere or an $N_2O$ atmosphere. Alternatively, a metal film is formed and then a surface thereof is treated with a highly oxidative solution such as an ozone solution, so that an oxide or oxynitride of the metal film can be formed on the surface of the metal film.

The insulating film 703 is formed to have a single-layer structure or a stacked-layer structure of a film containing oxide of silicon or nitride of silicon by a sputtering method, a plasma CVD method, or the like. In the case where the insulating film to be a base has a two-layer structure, a silicon nitride oxide film may be formed for a first layer, and a silicon oxynitride film may be formed for a second layer, for example. In the case where the insulating film to be a base has a three-layer structure, a silicon oxide film, a silicon nitride oxide film, and a silicon oxynitride film may be formed for a first layer, a second layer, and a third layer, respectively. Alternatively, a silicon oxynitride film, a silicon nitride oxide film, and a silicon oxynitride film may be formed for a first layer, a second layer, and a third layer, respectively. The insulating film to be a base functions as a blocking film for preventing impurities from entering from the substrate 701.

The semiconductor film 704 is formed to a thickness of 25 to 200 nm (preferably, 30 to 150 nm) by a sputtering method, an LPCVD method, a plasma CVD method, or the like. As the semiconductor film 704, an amorphous silicon film may be formed, for example.

Next, the semiconductor film 704 is crystallized by laser beam irradiation. Note that the semiconductor film 704 may be crystallized by a method in which laser beam irradiation is combined with a thermal crystallization method using an RTA or an annealing furnace, or a thermal crystallization method using a metal element for promoting crystallization, or the like. After that, the obtained crystalline semiconductor film is etched so as to have a desired shape, so that crystalline semiconductor films 704*a* to 704*d* are formed. Then, a gate insulating film 705 is formed so as to cover the crystalline semiconductor films 704*a* to 704*d* (see FIG. 11B).

An example of a manufacturing step of the crystalline semiconductor films 704*a* to 704*d* is briefly described below. First, an amorphous semiconductor film (for example, an amorphous silicon film) with a thickness of 50 to 60 nm is formed by a plasma CVD method. Next, a solution containing nickel that is a metal element for promoting crystallization is retained on the amorphous semiconductor film, and a dehydrogenation treatment (at 500° C., for one hour) and a thermal crystallization treatment (at 550° C., for four hours) are performed on the amorphous semiconductor film, so that a crystalline semiconductor film is formed. After that, the crystalline semiconductor film is irradiated with laser light from a laser oscillator, and a photolithography method is used, so that the crystalline semiconductor films 704*a* to 704*d* are formed. Note that without being subjected to the thermal crystallization which uses the metal element for promoting crystallization, the amorphous semiconductor film may be crystallized only by laser beam irradiation.

As a laser oscillator, a continuous wave laser beam (a CW laser beam) or a pulsed wave laser beam (a pulsed laser beam) can be used. As a laser beam which can be used here, a laser beam emitted from one or more of the following can be used: a gas laser-such as an Ar laser, a Kr laser, or an excimer laser; a laser of which medium is single crystalline YAG, $YVO_4$, forsterite ($Mg_2SiO_4$), $YAlO_3$, or $GdVO_4$, or polycrystalline (ceramic) YAG, $Y_2O_3$, $YVO_4$, $YAlO_3$, or $GdVO_4$, added with one or more of Nd, Yb, Cr, Ti, Ho, Er, Tm, and Ta as a dopant; a glass laser; a ruby laser; an alexandrite laser; a Ti:sapphire laser; a copper vapor laser; and a gold vapor laser. It is possible to obtain crystals with a large grain size when fundamental waves of such laser beams or second to fourth harmonics of the fundamental waves are used. For example, the second harmonic (532 nm) or the third harmonic (355 nm) of an Nd:$YVO_4$ laser (fundamental wave of 1064 nm) can be used. In this case, a power density of approximately 0.01 to 100 MW/cm$^2$ (preferably, 0.1 to 10 MW/cm$^2$) is necessary. Irradiation is conducted at a scanning rate of approximately 10 to 2000 cm/sec. It is to be noted that, a laser using, as a medium, single crystalline YAG, $YVO_4$, forsterite ($Mg_2SiO_4$), $YAlO_3$, or $GdVO_4$, or polycrystalline (ceramic) YAG, $Y_2O_3$, $YVO_4$, $YAlO_3$, or $GdVO_4$ added with one or more of Nd, Yb, Cr, Ti, Ho, Er, Tm, and Ta as a dopant; an Ar ion laser; or a Ti:sapphire laser can be continuously oscillated. Furthermore, pulse oscillation thereof can be performed at a repetition rate of 10 MHz or more by carrying out Q switch operation, mode locking, or the like. In a case where a laser beam is oscillated at a repetition rate of equal to or higher than 10 MHz, after a semiconductor film is melted by a laser and before it is solidified, the semiconductor film is irradiated with a next pulse. Therefore, unlike a case of using a pulsed laser with a low repetition rate, a solid-liquid interface can be continuously moved in the semiconductor film, so that crystal grains which continuously grow in a scanning direction can be obtained.

Next, a gate insulating film 705 which covers the crystalline semiconductor films 704*a* to 704*d* is formed. The gate insulating film 705 is formed to have a single layer structure or a stacked-layer structure of a film containing oxide of silicon or nitride of silicon by a CVD method, a sputtering method, or the like. In specific, the gate insulating film 705 is formed to have a single layer structure or a stacked-layer structure of a silicon oxide film, a silicon oxinitride film, or a silicon nitride oxide film.

Alternatively, the gate insulating film 705 may be formed by performing a high-density plasma treatment on the crystalline semiconductor films 704*a* to 704*d* to oxidize or nitride the surfaces thereof. For example, the gate insulating film 705 is formed by a plasma treatment introducing a mixed gas of a rare gas such as He, Ar, Kr, or Xe and oxygen, nitrogen oxide ($NO_2$), ammonia, nitrogen, hydrogen, or the like. When excitation of the plasma in this case is performed by introduction of a microwave, plasma with a low electron temperature and high density can be generated. By an oxygen radical (there is a case where an OH radical is included) or a nitrogen radical (there is a case where an NH radical is included) generated by this high-density plasma, the surfaces of the semiconductor films can be oxidized or nitrided.

By treatment using such high-density plasma, an insulating film with a thickness of 1 to 20 nm, typically 5 to 10 nm, is formed over the semiconductor film. Since the reaction of this case is a solid-phase reaction, interface state density between the insulating film and the semiconductor film can be extremely low. Since such high-density plasma treatment oxidizes (or nitrides) a semiconductor film (crystalline silicon, or polycrystalline silicon) directly, unevenness of a thickness of the insulating film to be formed can be extremely small, ideally. In addition, oxidation is not strengthened even in a crystal grain boundary of crystalline silicon, which makes a very preferable condition. That is, by a solid-phase oxidation of the surface of the semiconductor film by the high-density plasma treatment shown here, an insulating film with good uniformity and low interface state density can be formed without abnormal oxidation reaction in a crystal grain boundary.

As the gate insulating film 705, an insulating film formed by the high-density plasma treatment may be used by itself, or an insulating film of silicon oxide, silicon oxynitride, silicon nitride, or the like may be formed thereover by a CVD method using plasma or thermal reaction, so as to make stacked layers. In any case, transistors each including an insulating film formed by high-density plasma, in a part of the gate insulating film or in the whole gate insulating film, can reduce variation in the characteristics.

Furthermore, a semiconductor film is irradiated with a continuous wave laser beam or a laser beam oscillated at a repetition rate of equal to or higher than 10 MHz and is scanned in one direction for crystallization, so that each of the semiconductor films 704*a* to 704*d* which has a characteristic that the crystal grows in the scanning direction of the laser beam is obtained. When transistors are provided so that the scanning direction is aligned with the channel length direction (a direction in which carriers flow when a channel formation region is formed) and the above gate insulating layer is used, thin film transistors (TFTs) with less characteristic variation and high field effect mobility can be obtained.

Next, a first conductive film and a second conductive film are stacked over the gate insulating film 705. Here, the first conductive film is formed to a thickness of 20 to 100 nm by a plasma CVD method, a sputtering method, or the like, and the second conductive film is formed to a thickness of 100 to 400 nm. The first conductive film and the second conductive film are formed using an element selected from tantalum (Ta), tungsten (W), titanium (Ti), molybdenum (Mo), aluminum (Al), copper (Cu), chromium (Cr), niobium (Nb), and the like, or an alloy material or a compound material containing the above elements as its main component. Alternatively, they are formed using a semiconductor material typified by polycrystalline silicon doped with an impurity element such as phosphorus. As examples of a combination of the first conductive film and the second conductive film, a tantalum nitride film and a tungsten film, a tungsten nitride film and a tungsten film, a molybdenum nitride film and a molybdenum film, and the like can be given. Since tungsten and tantalum nitride have high heat resistance, heat treatment for thermal activation can be performed after the first conductive film and the second conductive film are formed. In addition, in a case of a three-layer structure instead of a two-layer structure, a stacked-layer structure of a molybdenum film, an aluminum film, and a molybdenum film is preferably employed.

Next, a resist mask is formed by a photolithography method, and etching treatment for forming a gate electrode and a gate wiring is performed, so that gate electrodes 707 are formed over the crystalline semiconductor films 704*a* to 704*d*.

Next, a resist mask is formed by a photolithography method, and an impurity element imparting n-type conductivity is added to the crystalline semiconductor films 704*a* to 704*d* at low concentration by an ion doping method or an ion implantation method. As an impurity element imparting n-type conductivity, an element which belongs to Group 15 may be used. For example, phosphorus (P) or arsenic (As) is used.

Next, an insulating film is formed so as to cover the gate insulating film 705 and the gate electrodes 707. The insulating film is formed to have a single-layer structure or a stacked-layer structure of a film including an inorganic material such as silicon, an oxide of silicon, or a nitride of silicon, and an organic material such as an organic resin, by a plasma CVD method, a sputtering method, or the like. Next, the insulating film is selectively etched by anisotropic etching for mainly etching in a perpendicular direction, so that insulating films 708 (also referred to as side walls) which are in contact with side surfaces of the gate electrodes 707 are formed. The insulating films 708 are used as masks for doping when LDD (lightly doped drain) regions are formed later.

Next, a resist mask formed by a photolithography method, the gate electrodes 707, and the insulating films 708 are used as masks to add an impurity element imparting n-type conductivity to the crystalline semiconductor films 704*a* to 704*d*, so that channel formation regions 706*a*, first impurity regions 706*b*, and second impurity regions 706*c* are formed (see FIG. 11C). The first impurity regions 706*b* function as source and drain regions of the thin film transistor, and the second impurity regions 706*c* function as LDD regions. The concentration of impurity elements contained in the second impurity regions 706*c* is lower than that of impurity elements contained in the first impurity regions 706*b*.

Next, an insulating film is formed as a single layer or stacked layers so as to cover the gate electrodes 707, the insulating films 708, and the like, so that conductive films 731 which function as source and drain electrodes of the thin film transistor are formed over the insulating film. Consequently, an element layer 751 including thin film transistors 730*a* to 730*d* is obtained (see FIGS. 11D and 9B). Note that an element such as the thin film transistor may be provided on an entire surface of the region 750 or over a portion of the region 750 excluding a part (such as a central portion) as described in the above embodiment mode.

The insulating film is formed as a single layer or stacked layers using an inorganic material such as an oxide of silicon or a nitride of silicon, an organic material such as polyimide, polyamide, benzocyclobutene, acrylic, or epoxy, a siloxane material, or the like, by a CVD method, a sputtering method, an SOG method, a droplet discharging method, a screen printing method, or the like. Here, the insulating film is formed to have a two-layer structure. A silicon nitride oxide film is formed as a first insulating film 709, and a silicon oxynitride film is formed as a second insulating film 710.

It is to be noted that before the insulating films 709 and 710 are formed or after one or more of the insulating films 709 and 710 are formed, heat treatment for recovering the crystallinity of the semiconductor film 704, for activating the impurity element which has been added to the semiconductor film, or for hydrogenating the semiconductor film is preferably performed. For the heat treatment, thermal annealing, a laser annealing method, an RTA method, or the like is preferably employed.

The conductive films 731 are formed in the following manner. The insulating films 709 and 710, and the like are etched by a photolithography method, and contact holes are formed to expose the first impurity regions 706*b*. Then, a conductive film is formed so as to fill the contact holes and the conductive film is selectively etched so as to form. It is to be noted that before formation of the conductive film, a silicide may be formed over the surfaces of the semiconductor films 704*a* to 704*d* exposed in the contact holes.

The conductive film 731 is formed by a CVD method, a sputtering method, or the like to have a single-layer structure or a stacked-layer structure with the use of an element selected from aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), and silicon (Si), or an alloy material or a compound material containing any of the above elements as its main component. An alloy material containing aluminum as its main component corresponds to a material which contains aluminum as its main component and also contains nickel, or an alloy material which contains aluminum as its main component and also contains nickel and one or both of carbon and silicon, for example. The conductive film 731 may employ, for example, a stacked layer structure of a barrier film, an aluminum-silicon (Al—Si) film, and a barrier film, or a stacked layer structure of a barrier film, an aluminum-silicon (Al—Si) film, a titanium nitride film, and a barrier film. It is to be noted that a barrier film corresponds to a thin film formed by using titanium, a nitride of titanium, molybdenum, or a nitride of molybdenum. Aluminum and aluminum silicon which have low resistance and are inexpensive are optimal materials for forming the conductive film 731. In addition, generation of a hillock of aluminum or aluminum silicon can be prevented when upper and lower barrier layers are formed. Furthermore, when the barrier film is formed by using titanium that is a highly-reducible element, even if a thin natural oxide film is formed over the crystalline semiconductor film, the natural oxide film can be reduced so that preferable contact with the crystalline semiconductor film can be obtained.

Figures 12A, 12B, 12C:
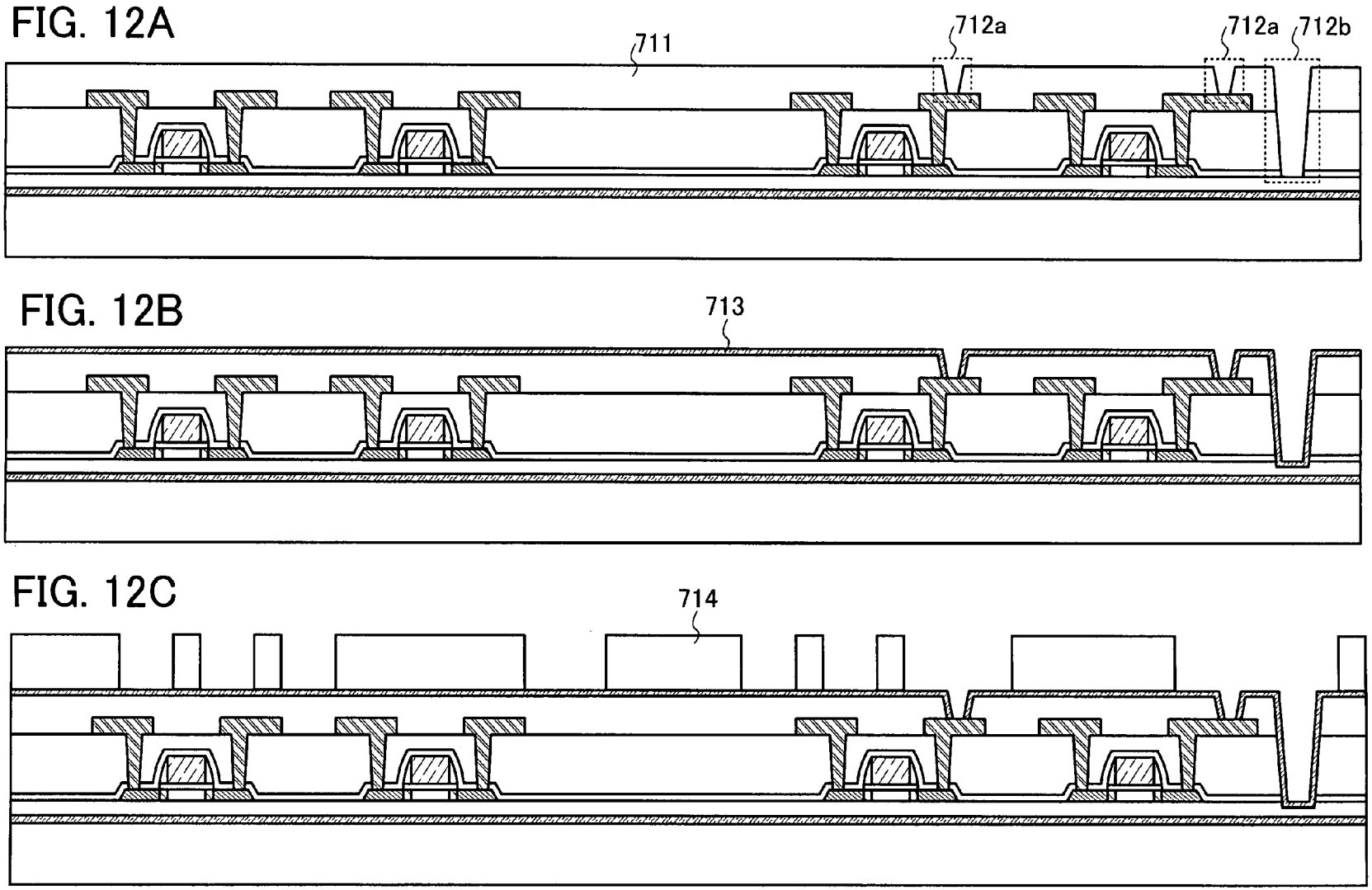
FIGS. 12A to 12C are views showing an example of a method for manufacturing a semiconductor device of the present invention.

Next, an insulating film 711 is formed so as to cover the conductive films 731, and openings 712*a* and 712*b* are formed in the insulating film 711 (see FIG. 12A). Here, the openings 712*a* are formed so that the conductive films 731 which function as source electrodes or drain electrodes of the thin film transistor 730*c* and the thin film transistor 730*d*. The opening 712*b* is formed so that the insulating film 703 is exposed. The insulating film 711 is formed to have a single-layer structure or a stacked-layer structure by using an inorganic material or an organic material by a CVD method, a sputtering method, an SOG method, a droplet discharging method, a screen printing method, or the like. The insulating film 711 is preferably formed to a thickness of 0.75 to 3 μm. Note that the opening 712*b* may be formed so that the insulating film 702 is exposed or may be formed so that the substrate 701 is exposed or a depression is formed in the substrate 701.

Next, a thin metal film 713 is formed on a surface of the insulating film 711 and surfaces of exposed portions of the insulating films 703, 709, and 710 (see FIG. 12B). The surface of the insulating film 711 and the surfaces of the exposed portions of the insulating films 703, 709, and 710 are roughened and then plated, so that the metal film 713 can be formed. For example, the surface of the insulating film 711 and the surfaces of the exposed portions of the insulating films 703, 709, and 710 are chemically roughened to be uneven, and then an electroless copper (Cu) plating treatment may be performed. The plating treatment may be performed with nickel (Ni), gold (Au), platinum (Pt), silver (Ag), or the like instead of copper.

Next, a resist 714 is selectively formed over the metal film 713 (see FIG. 12C). The resist 714 is formed over a region excluding a portion where a conductive film is to be formed.

Figures 13A, 13B, 13C:
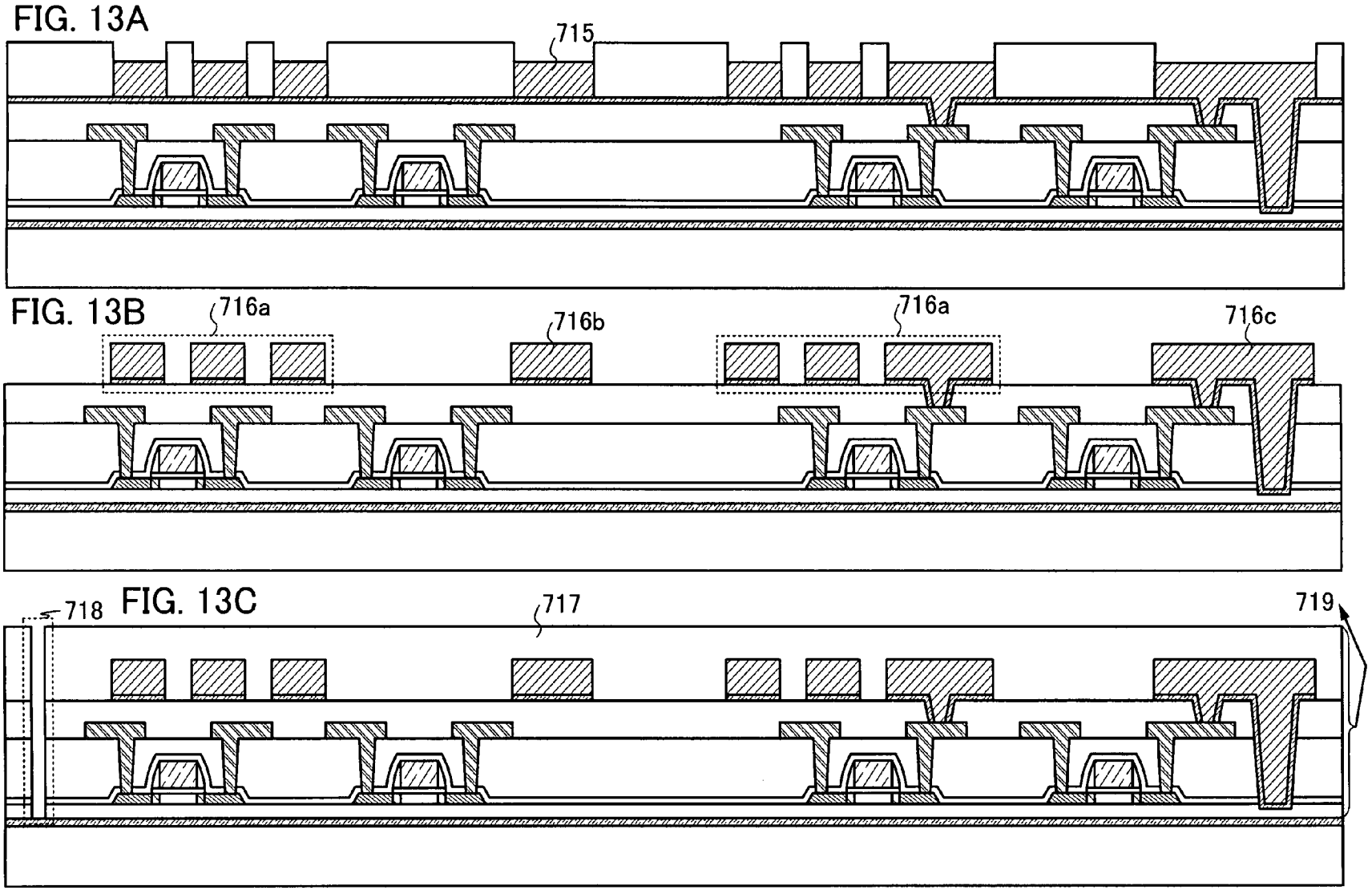
FIGS. 13A to 13C are views showing an example of a method for manufacturing a semiconductor device of the present invention.
Figure 14A:
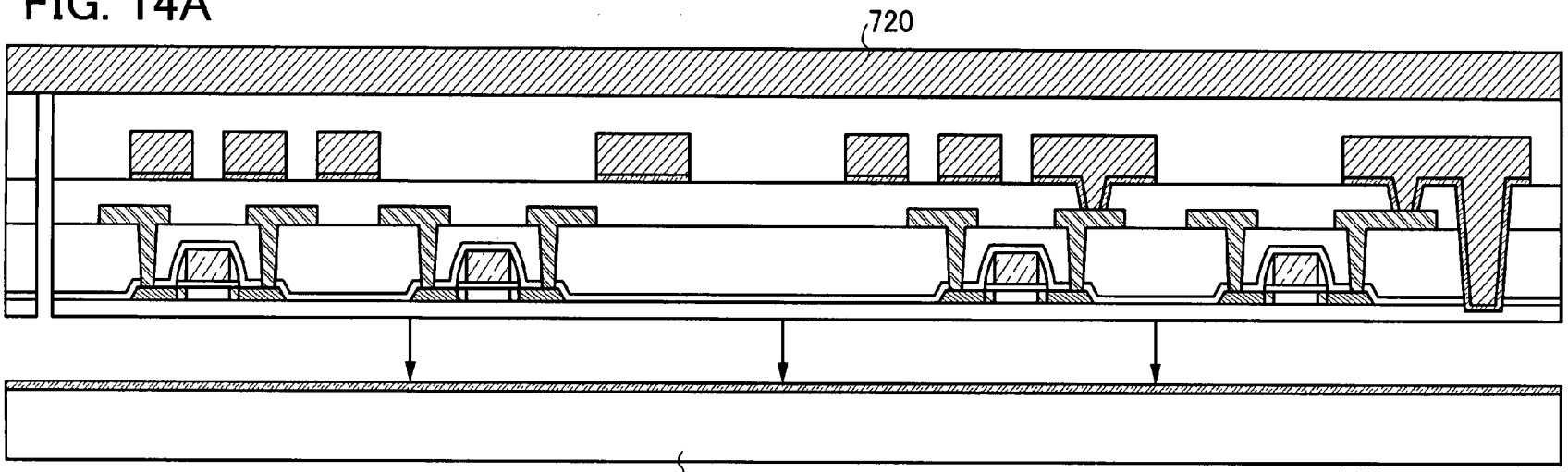
FIGS. 14A and 14B are views showing an example of a method for manufacturing a semiconductor device of the present invention.
Figure 14B:
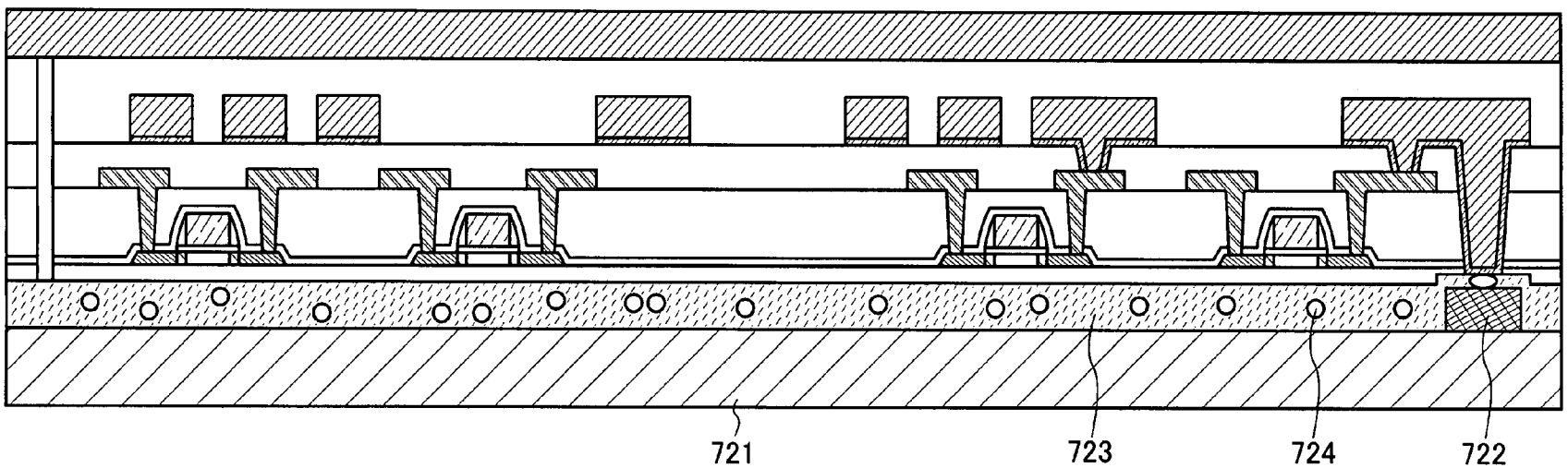

Next, a conductive film 715 is formed over portions of the metal film 713, which are not overlapped with the resist 714 (see FIG. 13A). The conductive film 715 can be formed by plating treatment. For example, a plating treatment with copper (Cu) can be employed. The plating treatment may be performed with nickel (Ni), gold (Au), platinum (Pt), silver (Ag), or the like instead of copper.

Figure 9C:
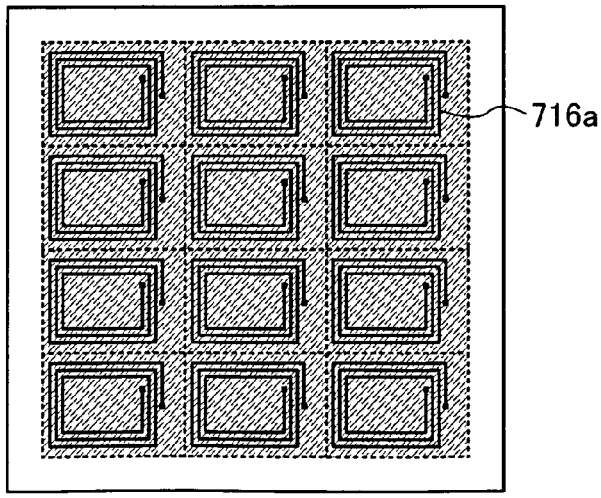

Next, the resist 714 and the portion of the metal film 713, which is not overlapped with the conductive film 715, are selectively removed, so that conductive films 716*a* to 716*c* are formed (see FIGS. 13B and 9C). Note that the conductive film 716*a* functions as an on-chip antenna and the conductive films 716*b* and 716*c* function as wirings in an element such as a thin film transistor. The conductive film 716*c* is the wiring for electrically connecting an antenna to be formed later.

In this embodiment mode, the conductive film (the conductive film 716*a*) which functions as an antenna and the conductive films (the conductive films 716*b* and 716*c*) function as wirings are formed at the same time. In that case, manufacturing steps can be reduced; therefore, the cost can be reduced. It is needless to say that the conductive film 716*a* which functions as an antenna and the conductive films 716*b* and 716*c* which function as wirings may be separately formed.

Note that a method for manufacturing the conductive films 716*a* to 716*c* is not limited to the method shown in FIGS. 12B to 13B. Similarly to the method for manufacturing the conductive film 731, the conductive films 716*a* to 716*c* may be formed by performing a CVD method, a sputtering method, or the like and then performing a photolithography method. Alternatively, a pattern may be directly formed by a droplet discharging method, a screen printing method, or the like. In order to form the conductive films 716*a* and 716*b* by a screen printing method, for example, after the state shown in FIG. 12A is obtained, a conductive paste of silver or the like is selectively formed over the insulating film 711 and then heating treatment is performed at 50 to 350° C. The conductive film 716*c* may be formed at the same time as the conductive films 731.

Next, an element formation layer 719 including the thin film transistors 730*a* to 730*d* and the conductive film 716*a* which functions as an antenna, and the like is released from the substrate 701.

Figure 10A:
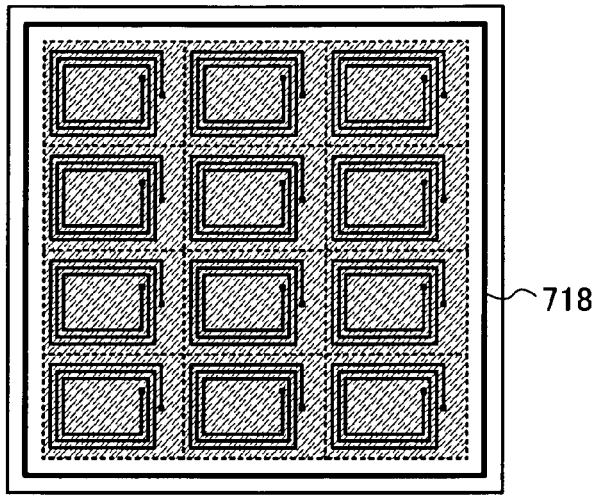
FIGS. 10A to 10C are diagrams showing an example of a method for manufacturing a semiconductor device of the present invention.
Figure 10B:
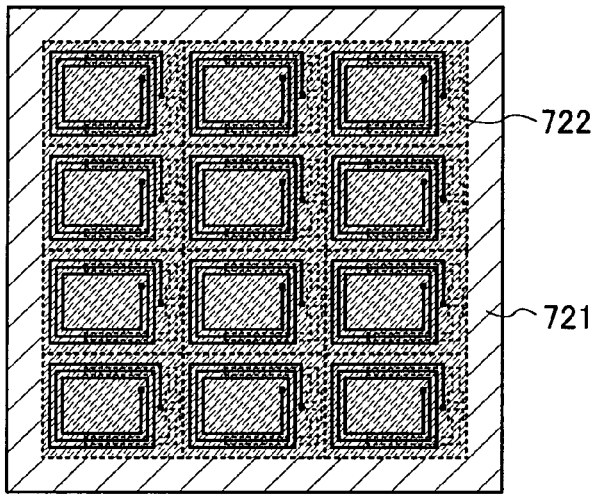

First, an insulating film 717 is formed so as to cover the conductive films 716*a* and 716*b* and then irradiated with a laser beam, so that an opening 718 is formed (see FIGS. 13C and 10A). After that, one surface (here, a surface of the insulating film 717) of the element formation layer 719 is attached to a sheet material 720, and then the element formation layer 719 is released from the substrate 701 (see FIG. 14A). As the sheet material 720, a plastic film such as a hot-melt film can be used. In the case of releasing the sheet material 720 later, a thermal releasing tape of which adhesion is reduced by being heated can be used.

Note that releasing is performed with a surface to be released getting wet with water or a solution such as ozone water, so that elements such as the thin film transistors 730*a*, 730*b*, 730*c*, and 730*d* can be prevented from being damaged by static electricity or the like. Further, by reusing of the substrate 701 from which the element formation layer 719 is released, the cost can be reduced.

After the conductive film 716*c* is exposed at the other surface of the element formation layer 719 (a surface exposed by releasing from the substrate 701) (see FIGS. 14B and 10B), the element formation layer 719 is electrically connected to a conductive film 722 which functions as an antenna. Here, the element formation layer 719 and the substrate 721 provided with the conductive film 722 are attached to each other using an adhesive resin 723. Further, the conductive film 716*c* is electrically connected to the conductive film 722 with a conductive particle 724 included in the resin 723. In such a manner, the plurality of element formation layers 719 are provided with the conductive films 722 at the same time, so that the manufacturing steps can be reduced.

Figure 16A:
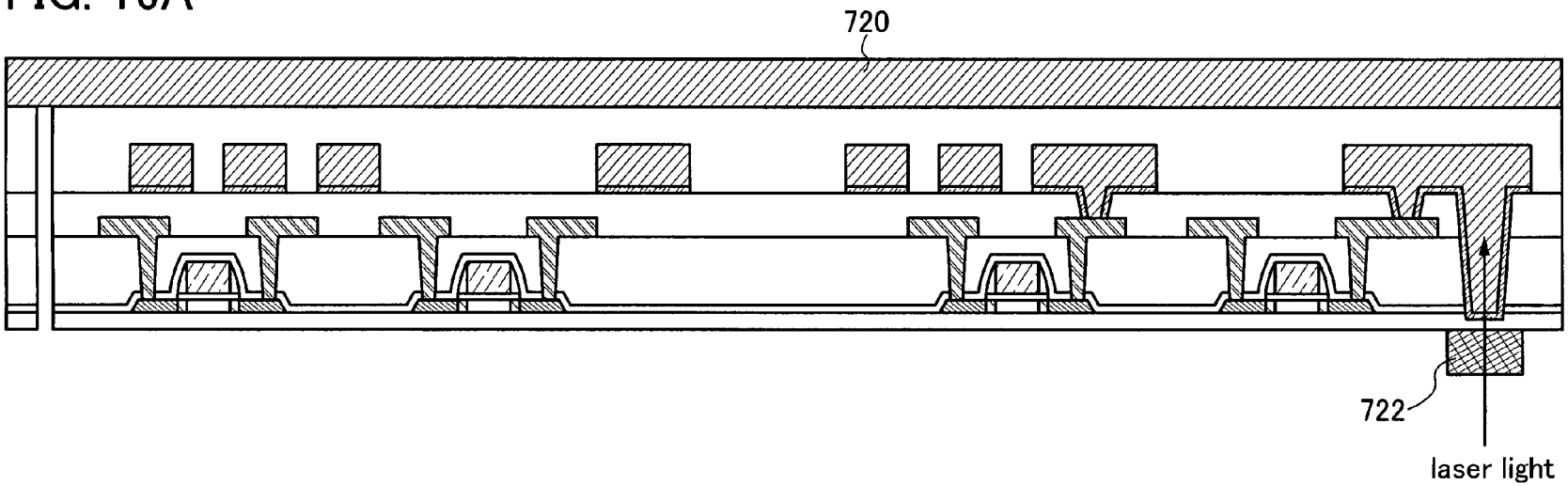
FIGS. 16A and 16B are views showing an example of a method for manufacturing a semiconductor device of the present invention.
Figure 16B:
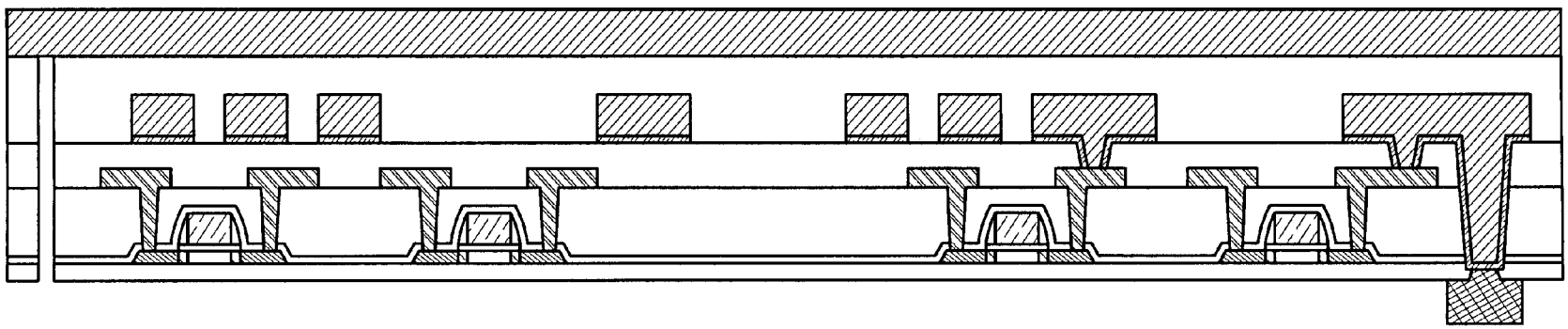

Therefore, the conductive film 722 is electrically connected to a thin film transistor 730*d* included in an integrated circuit portion through an insulating base (here, the insulating substrate 703). Note that in a case where the conductive film 716*c* is not exposed after the element formation layer 719 is released from the substrate 701, the insulating film 703 or the like is ground or polished so that the conductive film 716*c* can be exposed. Even in the case where the conductive film 716*c* is not exposed, the conductive film 722 is provided so as to overlap the conductive film 716*c* with the insulating film 703 or the like interposed therebetween and then laser beam irradiation is performed, so that the conductive film 716*c* and the conductive film 722 may be electrically connected (see FIGS. 16A and 16B).

As the substrate 721, a plastic substrate or the like can be used. With a plastic substrate, a flexible semiconductor device can be obtained at low cost. While the conductive film 722 functioning as an antenna, which is provided over the substrate 721, is attached to the element formation layer 719 here, the conductive film 722 may be formed on the other surface of the element formation layer 719 by a droplet discharging method, a screen printing method, or the like.

Figure 10C:
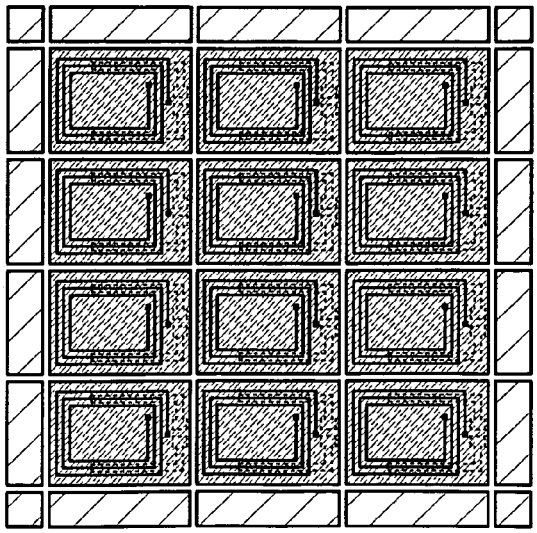
Figure 15:
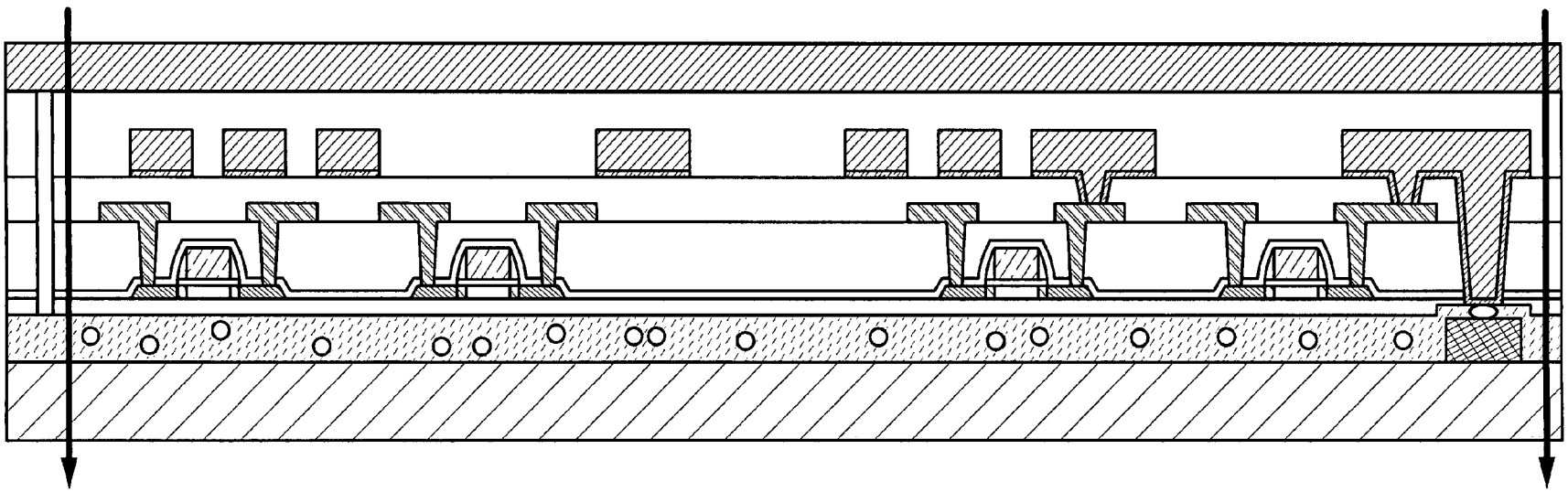
FIG. 15 is a view showing an example of a method for manufacturing a semiconductor device of the present invention.

Next, the element formation layer 719 provided with the conductive film 722 is selectively cut by dicing, scribing, a laser cutting method, or the like and thus, a plurality of semiconductor devices can be obtained (see FIGS. 15 and 10C). Note that in this embodiment mode, a semiconductor device is preferably formed to have a size of 3 mm×3 mm to 20 mm×20 mm.

Note that while the case is described where the substrate 721 provided with the conductive films 722 which function as antennas is attached to the element formation layer 719 and then cut so that a plurality of semiconductor devices are manufactured in this embodiment mode, the element formation layers 719 are cut into a plurality of pieces and then the substrates 721 each provided with the conductive film 722 which functions as an antenna may be attached to each of the plurality of the element formation layers 719. In that case, the integrated circuit portion including the element formation layer 719 and the substrate 721 can be provided to have different sizes. On the other hand, in the above process (FIGS. 14B to 15), the area of the substrate 721 is approximately equal to that of the integrated circuit portion including the element formation layer 719.

While this embodiment mode describes the case where an element such as a thin film transistor or an antenna is formed over the substrate 701 and then released from the substrate 701 so that a flexible semiconductor device is formed, the present invention is not limited to this.

For example, after the steps of FIGS. 11A to 13B are performed without providing the release layer 702 over the substrate 701, the substrate 701 is ground or polished to expose the conductive film 716*c* and then the conductive film 722 which functions as an antenna is attached to the conductive film 716*c*, so that a semiconductor device can be obtained. Alternatively, as shown in FIG. 12A, the opening 712*b* is formed so that a depression is formed in the substrate 701 and then the conductive film 722 is formed in the opening 712*b*, so that a semiconductor device provided with elements such as a thin film transistor and an antenna over the substrate 701 which has been thinned can be formed. In this case, the conductive film 722 which functions as an antenna is electrically connected to the thin film transistor through the substrate 701.

The method for manufacturing a semiconductor device, which is described in this embodiment mode, can be applied to manufacturing of the semiconductor device described in any of the other embodiment modes in this specification.

Embodiment Mode 5

In this embodiment mode, a method for manufacturing a semiconductor device, which is different from the method for manufacturing a semiconductor device of any of the above embodiment modes, is described with reference to the drawings.

Figures 17A, 17B, 17C, 17D:
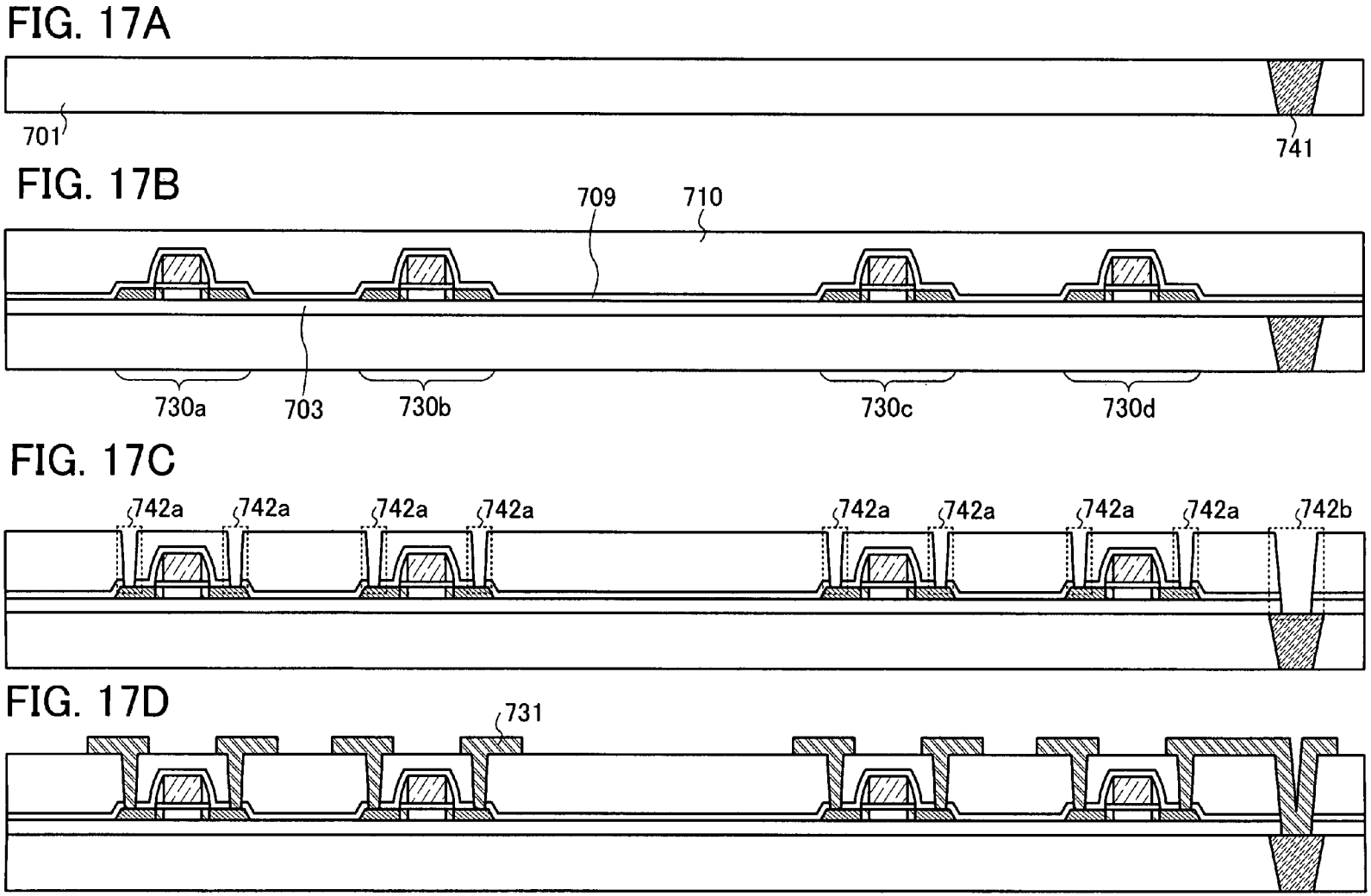
FIGS. 17A to 17D are views showing an example of a method for manufacturing a semiconductor device of the present invention.

First, the substrate 701 embedded with a conductive film 741 is prepared (see FIG. 17A). The conductive film 741 may be embedded so as to penetrate the substrate or may be embedded in a depression formed in the substrate 701.

Next, the thin film transistors 730*a* to 730*d* are provided over the substrate 701 with the insulating film 703 interposed therebetween (see FIG. 17B). The manufacturing method described in any of the above embodiment modes can be employed to form the thin film transistors 730*a* to 730*d*.

Next, openings 742*a* which reach source and drain regions of the thin film transistors 730*a* to 730*d* and the opening 742*b* which reaches the conductive film 741 formed in the substrate 701 are formed (see FIG. 17C).

Next, the conductive films 731 are selectively formed over the insulating film 710 and in the openings 742*a* and 742*b* (see FIG. 17D).

Figure 18A:
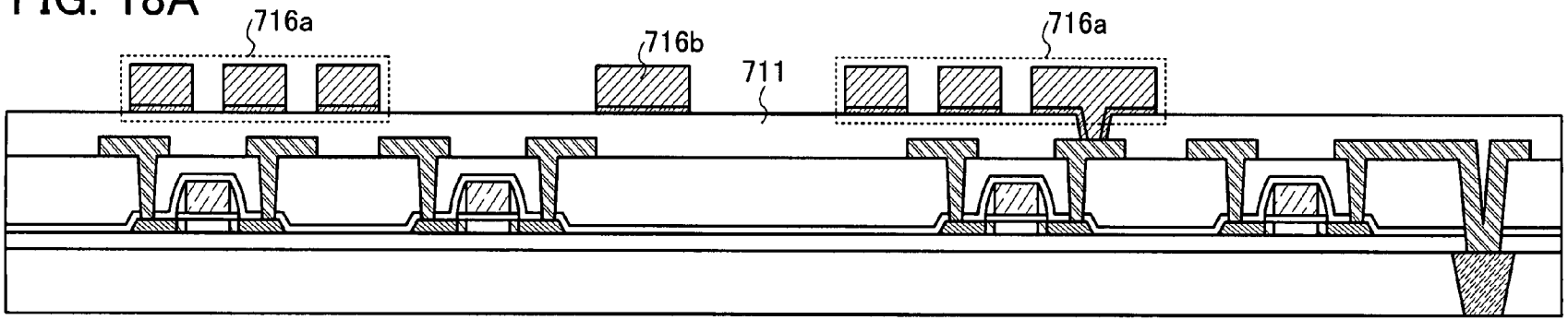
FIGS. 18A and 18B are views showing an example of a method for manufacturing a semiconductor device of the present invention.

Next, the conductive film 716*a* which functions as an antenna and the conductive film 716*b* which functions as a wiring are formed with the insulating film 711 interposed therebetween (see FIG. 18A).

Figure 18B:
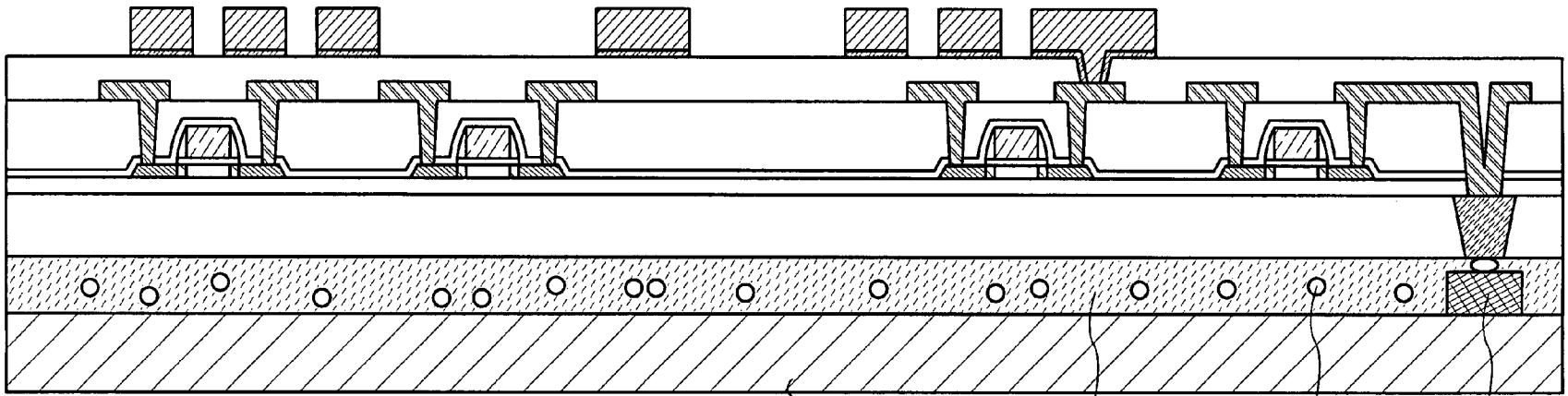

Next, the conductive film 722 which functions as an antenna is provided so as to be electrically connected to the conductive film 741 (see FIG. 18B). Here, the substrate 701 is attached to the substrate 721 provided with the conductive film 722 with the adhesive resin 723. Further, the conductive film 741 and the conductive film 722 are electrically connected to each other with the conductive particle 724 included in the resin 723. Note that in the case of forming the conductive film 741 in the depression of the substrate 701, after the substrate 701 is thinned by being ground or polished to expose the conductive film 741, the conductive film 741 is connected to the conductive film 722.

Thus, with a substrate embedded with a conductive film, a step for etching a substrate is omitted so that the manufacturing process can be simplified. Further, an impurity such as a dust caused with etching of the substrate can be eliminated.

The method for manufacturing a semiconductor device, which is described in this embodiment mode, can be applied to manufacturing of the semiconductor device described in any of the other embodiment modes in this specification.

Embodiment Mode 6

In this embodiment mode, a method for manufacturing a semiconductor device, which is different from that of any of the above embodiment modes, is described with reference to the drawings. In specific, a method for manufacturing a semiconductor device having a booster antenna is described.

Figure 19A:
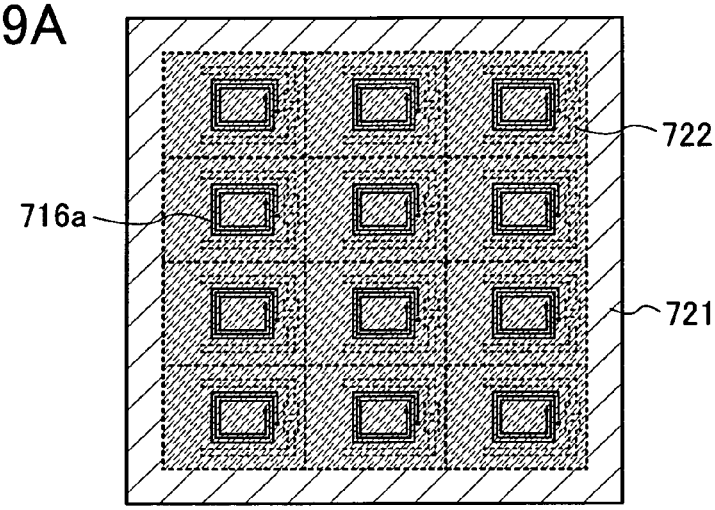
FIGS. 19A to 19C are diagrams showing an example of a method for manufacturing a semiconductor device of the present invention.

First, the structure shown in FIGS. 11A to 14B is similarly formed. After that, the sheet material 720 is released (see FIGS. 19A and 20A).

Figure 19B:
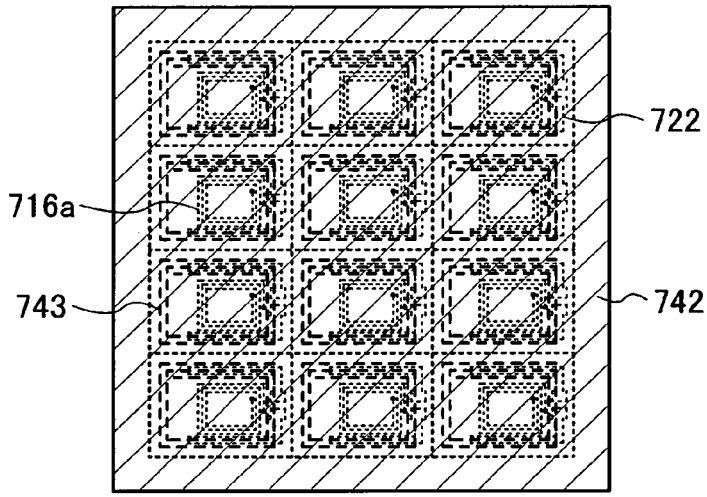
Figure 19C:
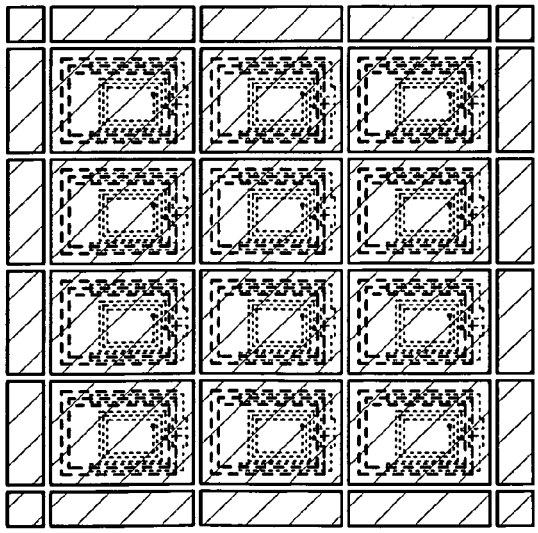
Figures 20A, 20B:
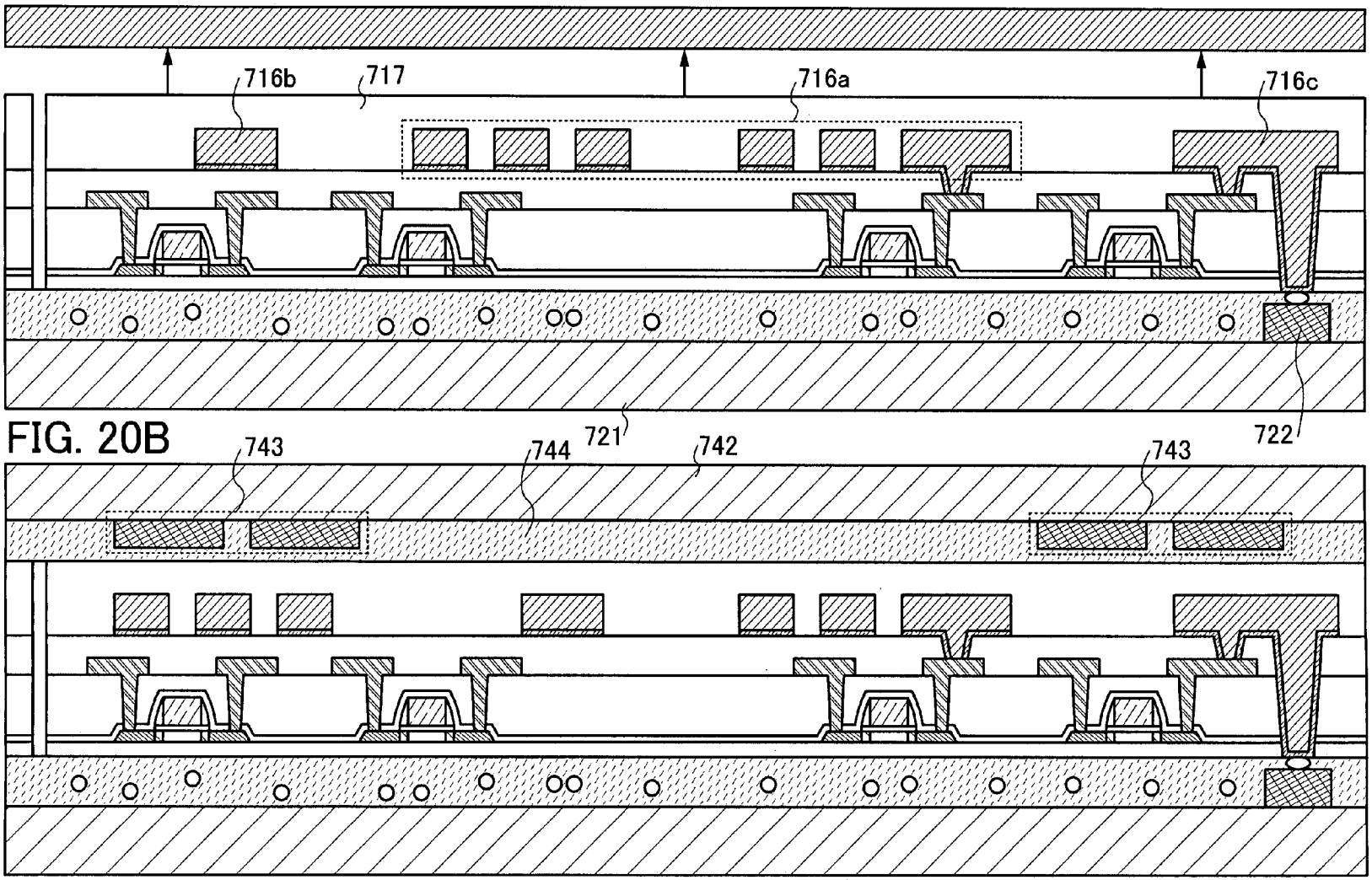
FIGS. 20A and 20B are views showing an example of a method for manufacturing a semiconductor device of the present invention.

Next, a substrate 742 provided with a conductive film 743 which functions as a booster antenna is attached to one surface of the element formation layer 719 (here, the surface of the insulating film 717) (see FIGS. 19B and 20B). Here, the substrate 742 provided with the conductive film 743 is attached to the one surface of the element formation layer 719 with an adhesive resin 744, and then, is selectively cut by dicing, scribing, a laser cutting method, or the like as shown in FIG. 15 and thus a plurality of semiconductor devices can be obtained (see FIG. 19C).

Note that the conductive film 743 formed in the substrate 742 and an element such as a thin film transistor, which is formed for the element formation layer 719 are provided so as not to be connected to each other. That is, in the semiconductor device described in this embodiment mode, the conductive film 716*a* is an on-chip antenna and the conductive film 743 is an external antenna (booster antenna). Therefore, data is transmitted and received with the outside (communication device) with the use of the antenna formed of the conductive film 743. Data is transmitted and received between the antenna formed of the conductive film 743 and the antenna formed of the conductive film 716*b* so that the semiconductor device can communicate with the outside.

As described above, the semiconductor device described in this embodiment mode is provided so that each of the areas of the booster antenna and the integrated circuit portion which are included in the semiconductor device is approximately equal to the area of the substrate 721. With such a structure, even in a case where the position (layout) of the conductive film 716*a* which functions as an on-chip antenna is limited due to connection of a thin film transistor or the like (for example, in a case of providing the conductive films 716*a* and 716*b* over one film), communication distance can be held.

The method for manufacturing a semiconductor device, which is described in this embodiment mode, can be applied to manufacturing of the semiconductor device described in any of the other embodiment modes in this specification.

Embodiment Mode 7

In this embodiment mode, application examples of the semiconductor device of the present invention are described. It is to be noted that an applicable range of the semiconductor device of the present invention is wide, and the semiconductor device can be applied to any product as long as it clarifies information such as the history of an object without contact and is useful for production, management, or the like. For example, the semiconductor device can be mounted on bills, coins, securities, certificates, bearer bonds, packing containers, books, recording media, personal belongings, vehicles, food, clothing, health products, commodities, medicine, electronic devices, and the like. Examples of them are described with reference to FIGS. 21A to 21H.

Figure 21A:
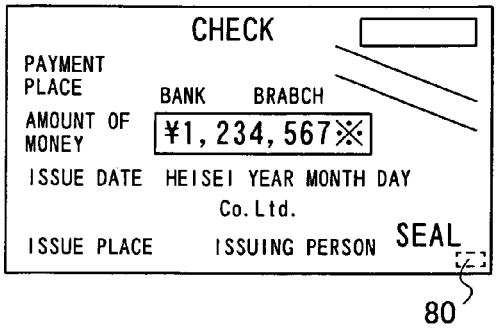
FIGS. 21A to 21H are diagrams showing application examples of a semiconductor device of the present invention.
Figure 21B:
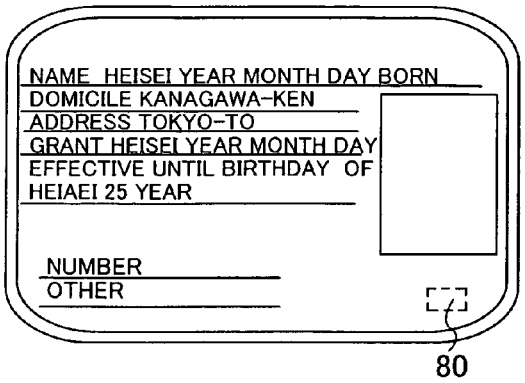
Figure 21C:
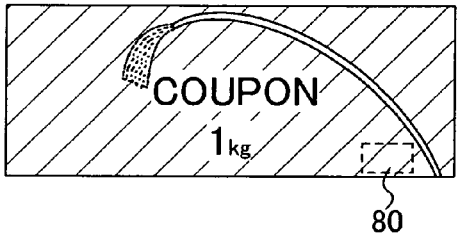
Figure 21D:
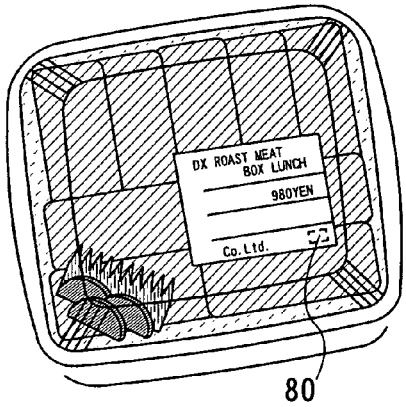
Figure 21E:
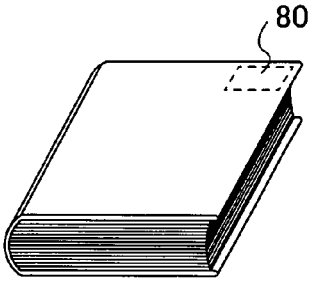
Figure 21F:
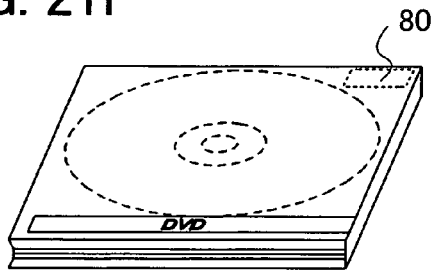
Figure 21G:
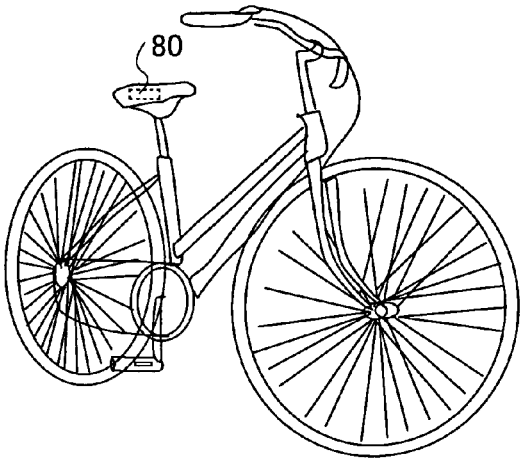
Figure 21H:
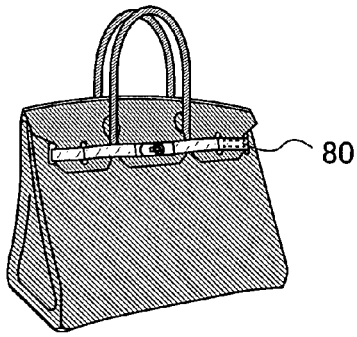

The bills and coins are money distributed to the market, and include one valid in a certain area (cash voucher), memorial coins, and the like. The securities refer to checks, certificates, promissory notes, and the like (FIG. 21A). The certificates refer to driver's licenses, certificates of residence, and the like (FIG. 21B). The bearer bonds refer to stamps, rice coupons, various gift certificates, and the like (FIG. 21C). The packing containers refer to wrapping paper for food containers and the like, plastic bottles, and the like (FIG. 21D). The books refer to hardbacks, paperbacks, and the like (FIG. 21E). The recording media refer to DVD software, video tapes, and the like (FIG. 21F). The vehicles refer to wheeled vehicles such as bicycles, ships, and the like (FIG. 21G). The personal belongings refer to bags, glasses, and the like (FIG. 21H). The food refers to food articles, drink, and the like. The clothing refers to clothes, footwear, and the like. The health products refer to medical instruments, health instruments, and the like. The commodities refer to furniture, lighting equipment, and the like. The medicine refers to medical products, pesticides, and the like. The electronic devices refer to liquid crystal display devices, EL display devices, television devices (TV sets and flat-screen TV sets), cellular phones, and the like.

Forgery can be prevented by mounting the semiconductor device 80 on the bills, the coins, the securities, the certificates, the bearer bonds, or the like. The efficiency of an inspection system, a system used in a rental shop, or the like can be improved by mounting the semiconductor device 80 on the packing containers, the books, the recording media, the personal belongings, the food, the commodities, the electronic devices, or the like. Forgery or theft can be prevented by mounting the semiconductor device 80 on the vehicles, the health products, the medicine, or the like; further, in a case of the medicine, medicine can be prevented from being taken mistakenly. The semiconductor device 80 can be mounted on the foregoing article by being attached to the surface or being embedded therein. For example, in a case of a book, the semiconductor device 80 may be embedded in a piece of paper; in the case of a package made from an organic resin, the semiconductor device 80 may be embedded in the organic resin.

As described above, the efficiency of an inspection system, a system used in a rental shop, or the like can be improved by mounting the semiconductor device on the packing containers, the recording media, the personal belonging, the food, the clothing, the commodities, the electronic devices, or the like. In addition, by mounting the semiconductor device on the vehicles, forgery or theft can be prevented. Further, by implanting the semiconductor device in a creature such as an animal, an individual creature can be easily identified. For example, by implanting the semiconductor device with a sensor in a creature such as livestock, its health condition such as a current body temperature as well as its birth year, sex, breed, or the like can be easily managed. In particular, with the use of the semiconductor device described in any of the above embodiment modes, a defect of the semiconductor device accompanied with disconnection between an antenna and an IC chip can be prevented and a communication distance can be held even when the semiconductor device is provided on a curved surface or a product is bent.

The method for manufacturing the semiconductor device described in this embodiment mode can be applied to the semiconductor device of any of the other embodiment modes in this specification.

This application is based on Japanese Patent Application serial no. 2007-030858 filed with Japan Patent Office on Feb. 9, 2007, the entire contents of which are hereby incorporated by reference.

What is claimed is:

1. A semiconductor device comprising:

an integrated circuit portion over a first surface of an insulating base, the integrated circuit portion including a thin film transistor;

an insulating layer over the integrated circuit portion;

a first antenna over the insulating layer; and a second antenna on a second surface of the insulating base, wherein the first antenna is electrically connected to the integrated circuit portion through a first through hole formed in the insulating layer, wherein the second antenna is electrically connected to the integrated circuit portion through a second through hole formed in the insulating base, and wherein the first antenna and the second antenna overlap with the integrated circuit portion.

2. The semiconductor device according to claim 1, wherein the first antenna and the second antenna receive different frequencies.

3. A semiconductor device comprising:

an integrated circuit portion over a first surface of an insulating base, the integrated circuit portion including a thin film transistor;

an insulating layer over the integrated circuit portion;

a first antenna over the insulating layer; and a second antenna over a substrate, wherein the first antenna is electrically connected to the integrated circuit portion through a first through hole formed in the insulating layer, wherein the second antenna is electrically connected to the integrated circuit portion through a second through hole formed in the insulating base, and wherein the substrate adheres to the insulating base by an adhesive resin.

4. The semiconductor device according to claim 3, wherein an area of the integrated circuit portion is approximately equal to an area of the substrate.

5. The semiconductor device according to claim 4, wherein the area of the integrated circuit portion is 9 to 400 $mm^2$.

6. The semiconductor device according to claim 3, wherein the first antenna and the second antenna receive different frequencies.

7. A semiconductor device comprising:

a first integrated circuit portion and a second integrated circuit portion over a first surface of an insulating base, each of the first and second integrated circuit portions including a thin film transistor;

an insulating layer over the first integrated circuit portion and the second integrated circuit portion;

a first antenna over the insulating layer; and a second antenna on a second surface of the insulating base, wherein the first antenna is electrically connected to the first integrated circuit portion through a first through hole formed in the insulating layer, wherein the second antenna is electrically connected to the second integrated circuit portion through a second through hole formed in the insulating base, and wherein the first antenna and the second antenna overlap with the first integrated circuit portion and the second integrated circuit portion.

8. The semiconductor device according to claim 7, wherein the first integrated circuit portion and the second integrated circuit portion each include a transmitting and receiving circuit portion.

9. The semiconductor device according to claim 7, wherein the first antenna and the second antenna receive different frequencies.

10. A semiconductor device comprising:

an integrated circuit portion over a first surface of an insulating base, the integrated circuit portion including a thin film transistor;

a first antenna over the integrated circuit portion;

a second antenna on a second surface of the insulating base; and a third antenna over the first antenna, wherein the first antenna is electrically connected to the integrated circuit portion and transmits and receives data through the third antenna, wherein the second antenna is electrically connected to the integrated circuit portion through a through hole formed in the insulating base, wherein the third antenna is a booster antenna which is insulated from the integrated circuit portion, and wherein the first antenna, the second antenna, and the third antenna overlap with the integrated circuit portion.

11. The semiconductor device according to claim 10, wherein the second antenna and the third antenna receive different frequencies.

12. A semiconductor device comprising:

an integrated circuit portion over a first surface of an insulating base, the integrated circuit portion including a thin film transistor;

a first antenna over the integrated circuit portion;

a second antenna over the first substrate; and a third antenna over the second substrate, wherein the first substrate adheres to the insulating base by an adhesive resin, wherein the second substrate adheres to an insulating film over the first antenna, wherein the first antenna is electrically connected to the integrated circuit portion and transmits and receives data through the third antenna, wherein the second antenna is electrically connected to the integrated circuit portion through a through hole formed in the insulating base, and wherein the third antenna is a booster antenna which is insulated from the integrated circuit portion.

13. The semiconductor device according to claim 12, wherein the integrated circuit portion, the first substrate, and the second substrate have approximately equal areas.

14. The semiconductor device according to claim 13, wherein the area of the integrated circuit portion is 9 to 400 $mm^2$.

15. The semiconductor device according to claim 12, wherein the second antenna and the third antenna receive different frequencies.

* * * * *